US006119293A

United States Patent [19]

Phillipson et al.

[11] Patent Number: 6,119,293

[45] Date of Patent: Sep. 19, 2000

[54] SUBMERGED SURFACE POOL CLEANING DEVICE

[75] Inventors: Brian H. Phillipson, Longwood; Paul Sebor; Daniela Sebor, both of Heathrow, all of Fla.

[73] Assignees: Moyra A. Phillipson Family Trust, Longwood; Daniella Sebor Family Trust, Heathrow, both of Fla.

[21] Appl. No.: 09/113,832

[22] Filed: Jul. 10, 1998

Related U.S. Application Data

[60] Provisional application No. 60/052,296, Jul. 11, 1997, and provisional application No. 60/052,625, Jul. 15, 1997.

[51] Int. Cl.[7] ..... E04H 4/16

[52] U.S. Cl. ..... 15/1.7; 15/246

[58] Field of Search ..... 15/1.7, 246

[56] References Cited

U.S. PATENT DOCUMENTS

| | | |
|---|---|---|
| 1,591,903 | 7/1926 | White . |
| 1,860,619 | 5/1932 | Pfau . |
| 1,970,290 | 8/1934 | Ernzer . |
| 2,085,701 | 6/1937 | Kitto . |
| 2,108,183 | 2/1938 | Sjoberg . |
| 2,869,170 | 1/1959 | Wessel . |
| 2,974,348 | 3/1961 | Wessel . |
| 3,023,741 | 3/1962 | O'Connor . |
| 3,481,250 | 12/1969 | Toby . |
| 3,676,885 | 7/1972 | Wulc . |
| 3,792,548 | 2/1974 | Hamano . |
| 3,803,658 | 4/1974 | Raubenheimer . |
| 3,820,189 | 6/1974 | Roth . |
| 3,928,202 | 12/1975 | Raubenheimer . |
| 3,949,442 | 4/1976 | Chandler . |
| 3,950,809 | 4/1976 | Schatzmann . |
| 3,959,838 | 6/1976 | Hannah . |
| 3,964,601 | 6/1976 | Armstrong . |
| 3,979,788 | 9/1976 | Strausak . |
| 3,995,733 | 12/1976 | Mead . |
| 4,023,227 | 5/1977 | Chauvier . |
| 4,084,535 | 4/1978 | Rees . |

(List continued on next page.)

FOREIGN PATENT DOCUMENTS

| | | |
|---|---|---|
| 557312 | 3/1960 | Belgium . |
| 0476413 A2 | 3/1992 | European Pat. Off. . |
| 0556029 A1 | 10/1993 | European Pat. Off. . |
| 0745744 A1 | 4/1996 | European Pat. Off. . |
| 767648 | 5/1934 | France . |
| 2520-422 | 7/1983 | France . |
| 3320922 | 12/1984 | Germany . |
| 3320923 | 12/1984 | Germany . |
| 61-75071 | 4/1986 | Japan . |
| 2172195 | 3/1986 | United Kingdom . |
| 2181339 | 4/1987 | United Kingdom . |

*Primary Examiner*—Robert J. Warden, Sr.
*Assistant Examiner*—Jennifer McNeil
*Attorney, Agent, or Firm*—Allen, Dyer, Doppelt, Milbrath & Gilchrist, P.A.

[57] ABSTRACT

A swimming pool cleaning device for automatically cleaning a submerged surface includes a forwardly inclined housing forming a flow passage between a surface to be cleaned and a suction hose. A flow control valve is operable within the flow passage and includes a flap pivotable from a seated position against the front wall of the housing for blocking flow through the passage to an unseated position in a spaced relation to the forward wall, permitting. A shoe is carried at an inlet to the flow passage and a flexible planar disc extends around the shoe for engaging the surface to be cleaned. A groove within the shoe bottom surface forms a channel with the surface for passage of debris and fluid flow through the channel. The flexible planar member includes slits extending from the peripheral edge inward toward the central opening to form a pedal-like segmented flange for splaying of each segment in response to travel of the cleaner over an irregularly contoured surface and facilitate an effective frictional contact with the surface. A steering mechanism is operable between the housing and shoe for rotating the housing about the shoe and planar member, and includes a ratchet and pawl operable between upper and lower steering members for providing free rotation in one direction in response to a pulsating fluid flow through the flow passage, while biasing against rotation in an opposing direction.

73 Claims, 26 Drawing Sheets

U.S. PATENT DOCUMENTS 4,085,539 4/1978 Hanson .
4,133,068 1/1979 Hofmann .
4,152,802 5/1979 Chauvier .
4,156,948 6/1979 Chauvier et al. .
4,181,216 1/1980 Cipu .
4,193,156 3/1980 Chauvier .
4,208,752 6/1980 Hofmann .
4,254,525 3/1981 Combest .
4,275,474 6/1981 Woodard .
4,351,077 9/1982 Hofmann .
4,365,375 12/1982 Grodin et al. .
4,402,101 9/1983 van Zyl .
4,429,429 2/1984 Altschul .
4,434,519 3/1984 Raubenheimer .
4,463,468 8/1984 Chauvier .
4,498,206 2/1985 Braukmann .
4,521,933 6/1985 Raubenheimer .
4,530,125 7/1985 Hofmann .
4,536,908 8/1985 Raubenheimer .
4,558,479 12/1985 Greskovics et al. .
4,560,418 12/1985 Raubenheimer .
4,589,986 5/1986 Greskovics et al. .
4,642,833 2/1987 Stoltz et al. .
4,656,683 4/1987 Raubenheimer .
4,686,728 8/1987 Rawlins .
4,692,956 9/1987 Kassis .
4,724,566 2/1988 Fawcett .
4,733,427 3/1988 Conrad .
4,742,593 5/1988 Kallenbach .
4,769,867 9/1988 Stoltz .
4,783,868 11/1988 O'Callaghan .
4,807,318 2/1989 Kallenbach .
4,817,225 4/1989 Stoltz .
4,837,886 6/1989 Rawlins .
4,849,024 7/1989 Supra .
4,872,524 10/1989 O'Connor .
4,920,599 5/1990 Rief .
4,939,806 7/1990 Supra .
4,949,419 8/1990 Kallenbach .
4,962,559 10/1990 Schuman .
5,001,800 3/1991 Parenti et al. .
5,014,382 5/1991 Kallenbach .
5,033,148 7/1991 Chauvier et al. .
5,093,950 3/1992 Heier .
5,099,535 3/1992 Chauvier et al. .
5,172,445 12/1992 Chandler .
5,197,158 3/1993 Noini .
5,208,521 5/1993 Aoyama .
5,226,205 7/1993 Pearce .
5,245,723 9/1993 Sommer .
5,256,207 10/1993 Sommer .
5,259,082 11/1993 Sebor .
5,265,297 11/1993 Gould et al. .
5,274,868 1/1994 Sebor .
5,279,012 1/1994 Sloan .
5,293,659 3/1994 Rief et al. .
5,303,444 4/1994 Sebor .
5,315,728 5/1994 Atkins .
5,317,777 6/1994 Stoltz .
5,335,395 8/1994 Allen .
5,337,433 8/1994 Gould et al. .
5,337,434 8/1994 Erlich .
5,351,355 10/1994 Chiniara .
5,379,473 1/1995 Rief et al. .
5,386,607 2/1995 Sebor .
5,404,607 4/1995 Sebor .
5,412,826 5/1995 Raubenheimer .
5,418,995 5/1995 Rice et al. .
5,421,054 6/1995 Dawson et al. .
5,428,854 7/1995 Rief et al. .
5,433,985 7/1995 Atkins .
5,435,031 7/1995 Minami et al. .
5,454,129 10/1995 Kell .
5,465,443 11/1995 Rice et al. .
5,469,596 11/1995 Rief et al. .
5,507,058 4/1996 Minami et al. .
5,542,141 8/1996 Albright .
5,617,606 4/1997 Scott, II et al. .
5,852,841 12/1998 Rissik .
5,896,610 4/1999 Sebor et al. .

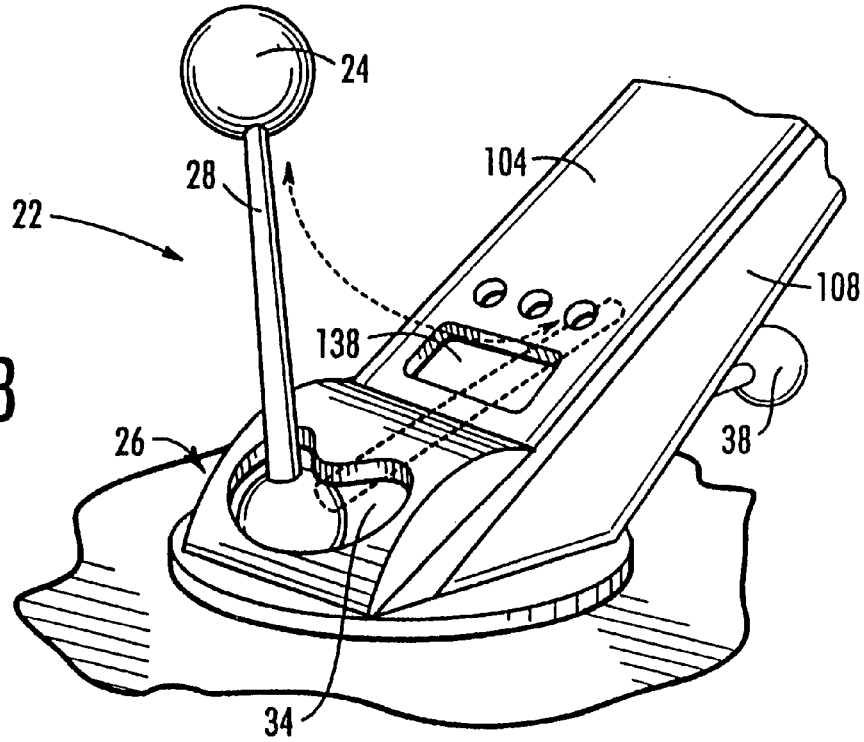
FIG. 8
FIG. 9
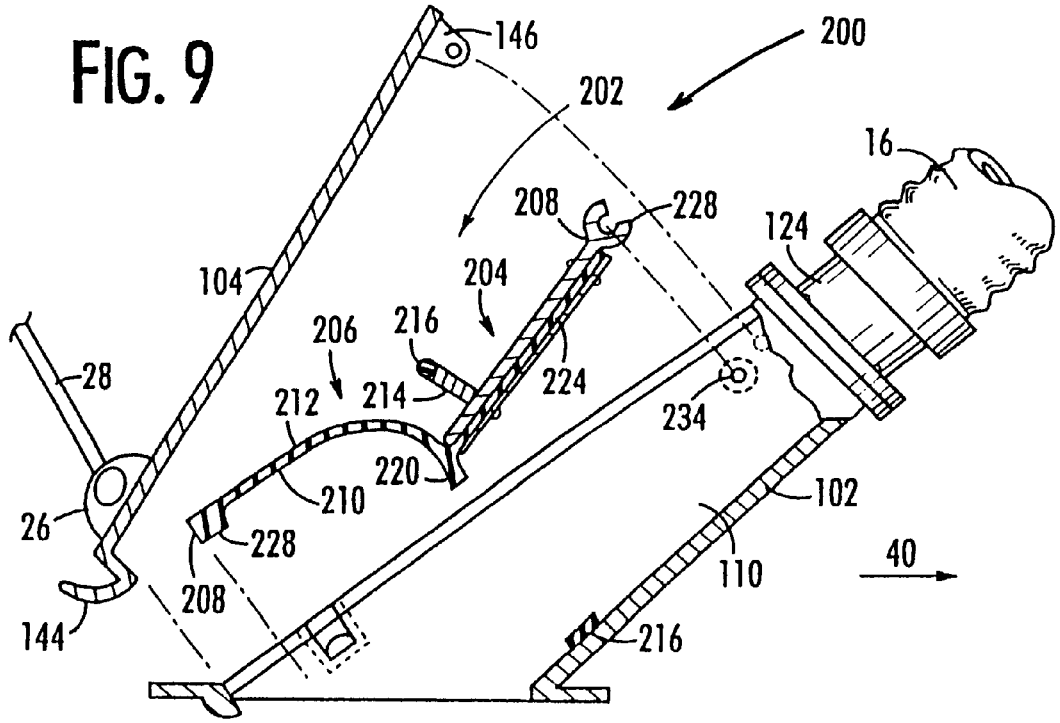

FIG. 23A
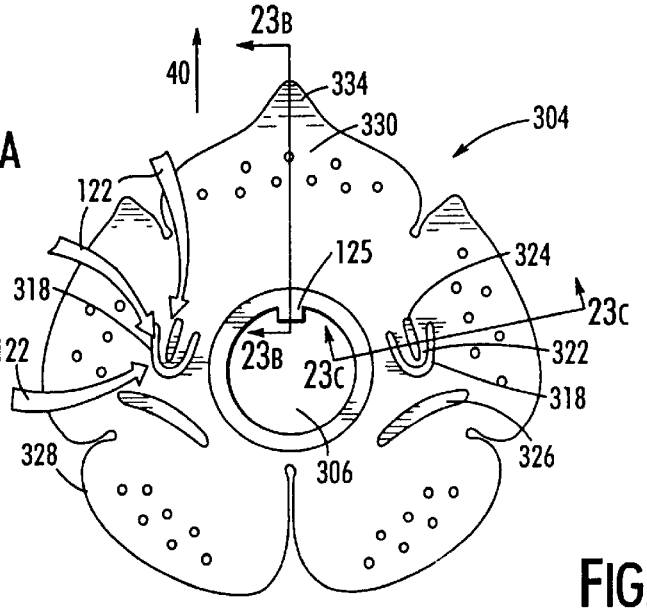
FIG. 23B
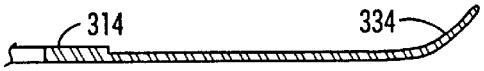
FIG. 23C
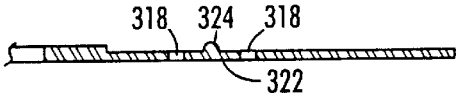
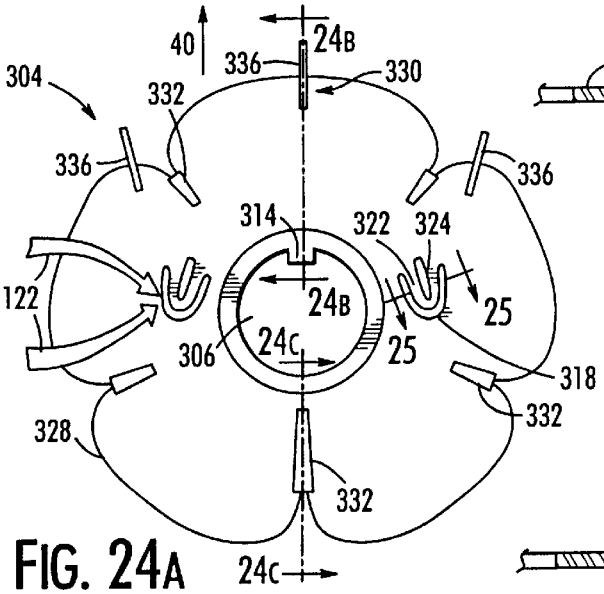
FIG. 24A
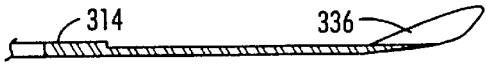
FIG. 24B
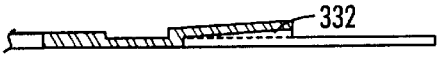
FIG. 24C

SUBMERGED SURFACE POOL CLEANING DEVICE

RELATED APPLICATIONS

This Application is related to Provisional Applications having Ser. No. 60/052,296, filed on Jul. 11, 1997 for "Steering Apparatus and Method for Pool Cleaner" and Ser. No. 60/052,625, filed Jul. 15, 1997 for "Submerged Surface Cleaning Device," both commonly owned with the instant application.

FIELD OF INVENTION

This invention relates generally to self-propelled devices for cleaning submerged surfaces. More particularly, it relates to a swimming pool cleaning device incorporating a flow control valve for establishing intermittent flow of a fluid through the cleaner and a rotating mechanism to assist the cleaner to steer away from obstructions and avoid repetitive patterns of travel across the surface to be cleaned.

BACKGROUND OF INVENTION

Mechanical pool cleaners which utilize the flow of water drawn through the cleaner by means of a connectable flexible suction pipe in communication with a filtration system pump are well known. Such pool cleaners are termed suction cleaners. Some suction cleaners interrupt the flow of the water induced through at least one passage through the cleaner to provide the propulsive force to move the cleaner in a random manner across the surface to be cleaned.

In U.S. Pat. No. 3,803,658 to Raubenheimer discloses a cleaning device which employs a water cut-off valve carried in rotational movement by a wheel driven by the flow of liquid through the cleaner. As is typical for a suction cleaner, a flexible hose leads from the suction chamber of the device to the suction side of the filtration system pump. When in use for cleaning a swimming pool, the hose becomes filled with water and the continuous opening and closing of the valve causes the hose to jerk. As the suction against the surface to be cleaned is momentarily released each time the gate closes, the jerking movement of the hose causes the head to move over the surface.

A water interruption pool cleaner developed by Chauvier and described in U.S. Pat. No. 4,023,227 uses the oscillatory movement of a flapper valve of substantially triangular cross-section displaceably located in the operating head of the cleaner and between two valve seats to alternately close off the flow of water drawn through a pair of passages in the cleaner which is connected by means of a suction pipe to the filtration system pump. The passages are located parallel to each other and are preferably oriented at an angle of 45° from the surface to be cleaned. The sudden halt of the flow of liquid through one passage applies an impulsive force to the apparatus due to the kinetic energy of the fluid flowing in the passage. This impulsive force is sufficient to displace the pool cleaner along the surface to be cleaned. Further, due to the inertia of the liquid in the passage to which flow is transferred, the pressure differential between the low pressure in the head and the ambient pressure of the water surrounding the cleaner is temporarily reduced, thereby decreasing the frictional engagement between the head of the pool cleaner and the surface, allowing the cleaner to be displaced.

By way of further example, water interruption pool cleaners which are more compact than the Chauvier device described above are disclosed in U.S. Pat. Nos. 4,133,068 and 4,208,752 issued to Hofmann. They employ an oscillatable valve adapted to alternately close a pair of passages in the head of the cleaner. A baffle plate is disposed in the head between the inlet and valve to cause one of the passages to be more restricted and less direct between inlet and outlet.

U.S. Pat. Nos. 4,682,833 and 4,742,593 to Stoltz and Kallenbach respectively, achieve autonomous water interruption by providing an assembly including a tubular flow passage at least partly defined by a transversely contractible and expandable tubular diaphragm, the tubular flow passage and tubular diaphragm are enclosed within a chamber formed by the body of the cleaner. The assembly includes means whereby pressures internally of the tubular diaphragm member and externally of tubular diaphragm member within the chamber formed around the member by the body are controlled so that, in use with fluid flowing through the diaphragm, it will be caused to automatically and repeatedly contract and expand. A pulsating flow of fluid through the assembly results and in forces cause the displacement of the pool cleaner apparatus over a surface to be cleaned.

To effect interruption of an induced flow through a swimming pool cleaner, U.S. Pat. No. 4,807,318 to Kallenbach discloses a tubular axially resilient diaphragm located within a chamber. One end of the diaphragm is closed and adapted to hold normally closed a rigid passage from the head of the pool cleaner to the usual form of suction pipe which connects the pool cleaner to the filtration unit. The diaphragm and its closed end also provide means for subjecting the interior of the diaphragm to variations in the pressure of water flow through the cleaner during use.

U.S. Pat. No. 4,769,867 to Stoltz describes a water interruption pool cleaner having a passage there through from an inlet end to an outlet in communication with a suction source. A valve in the form of jaw-like members is located at the fluid intake end of a rigid tubular section within a passage of the cleaner. In response to an induced flow of water through the valve and the tubular section, the jaw-like members automatically move relative to each other about an axis transverse to the length of and adjacent the end of the tubular section. The members are tapered towards each other to an inlet between them at their free ends with flexible membranes located between the sides of the jaws.

In another pool cleaner invention described in U.S. Pat. No. 4,817,225 to Stoltz, water interruption is achieved by means of a spherical closure member which is free to move in the head of the cleaner towards and away from a closure valve seat located at the upstream end of the outlet from the head. A hollow axially contractible resilient member is connected to the outlet at one end with its other end is connected to a flexible suction pipe.

U.S. Pat. No. 5,404,607 to Sebor for a Self Propelled Submersible Suction Cleaner uses an oscillator pivotally mounted within the flow path of a suction chamber to cause abrupt changes in water flow and thereby impart vibratory motion to the housing. Shoe means incorporating angled tread elements cooperate to move the housing along a forwardly direction of travel in response to the vibratory motion. Means are provided for converting a reciprocal angular movement or to and fro movement of the oscillator to an angular movement in one direction for purposes of driving a shaft. To enable the Sebor '607 cleaner to turn at established intervals throughout its travel over the surface to be cleaned, a drive gear is affixed to the shaft and engages a gear train which, in turn, engages a rotatable coupling at defined intervals to generate rotation of the coupling at these defined intervals. When in use, the rotatable coupling is connected to a flexible suction hose in communication with a filtration system pump.

Typically, a flapper valve used in such devices emit a hammering sound which can be irritating to a user. By way of example, if the swimming pool is located close to a building, the sound may resonate through the structure and be audible inside the rooms. Many devices known in the art are large and cumbersome. This impairs its maneuverability and effectiveness in smaller-sized pools and those where the transitions between the walls and/or between the floor and walls are sharp or tight. Debris such as twigs, berries and stones may become trapped in the operating head between the flapper valve and the valve seats. In order to clear debris or perform other maintenance tasks, it is difficult to gain access to the valve chamber, the flapper valve, valve seats and the openings in communication with the passages.

Sticks and larger pieces of debris may damage or puncture the flexible tubular member or may become entrapped in the members. Access to and removal of the flexible tubular member which is enclosed within a chamber is difficult and typically a non-technical person will avoid attempting easy repair. Replacement of the member may require tools which a typical homeowner may not have or be comfortable using. Often times, the pool cleaner provides a strong suction for effectively moving over the surface to be cleaned, but to its detriment fails to create a suction flow through the cleaner sufficient to remove sand located on the surface to be cleaned.

SUMMARY OF INVENTION

In view of the foregoing background, it is therefore an object of the present invention to provide a device for cleaning submerged surfaces such as those found in swimming pools. In particular, it is intended that the device is minimally intrusive with regard to both noise and overall size, is functionally and mechanically simple, is easy to install, is less prone to entrap debris than existing devices, incorporates easy access to the suction chamber for the removal of entrapped debris and includes means for maneuvering away from obstacles. Yet another object of the invention is to provide steering for directing the cleaning device on the submerged surface to maneuver away from obstacles. Further objects and advantages of the invention will become more apparent from a reading of the following description of the invention and embodiments thereof. It is also contemplated that the system and method are useful in fluid environments other than swimming pools and spas.

According to the invention, there is provided a device for cleaning surfaces submerged in a liquid. The device includes a housing in communication with a suction pump and motor by means of a flexible elongated hose connected to a coupling located at an exit end of the device. The coupling is rotatable in a preferred embodiment. The cleaning device incorporates at least one suction chamber or flow passage comprising an entrance end in proximity to the submerged surface to be cleaned and an exit end communicating with the coupling. The axis of a passage through the chamber is angled in a forward direction of travel with respect to the surface to be cleaned. A flow control valve is provided within the chamber or flow passage to cause, upon application of suction flow through the chamber, an automatic, repetitive interruption of the fluid flow therethrough, and thereby resultant forces capable of propelling the cleaner forward in the general direction indicated by the exit end of the chamber and the hose coupling.

The suction chamber comprises at least two sides, a front wall and a rear wall. The front wall is generally lateral to the direction of travel of the cleaner. To provide access to the inside of the chamber and the flow control valve, at least a portion of a wall or a side is detachable from the remainder of the chamber.

The flow control valve comprises at least one flap member mounted within at least one suction chamber. The flap member comprises two ends, two sides, a front face, a rear face, and at least one substantially rigid portion engaging the flexible portion. In a preferred embodiment, the flexible portion comprises resilient rubber-like material. Alternately, the flexible portion comprises multiple components or materials (including non-resilient materials) in a cooperative arrangement designed to perform the function of the flexible portion. Each end of the flap member is mounted between two sides of a suction chamber about axes generally transverse to the flow of liquid through the chamber. The flap member and the chamber in which it is mounted are dimensioned such that at least two sides of the flap member remain in close communication with at least two sides of the chamber. A substantially rigid portion of the flap member is pivotally mounted closer to the exit end of the chamber and away from both the front and rear walls. A flexible portion of the flap member is mounted closer to the chamber entrance end and attached to or in close proximity to the rear wall of the suction chamber. At least a portion of the flap member must be capable of travel into a position of close proximity or contact with the front wall of the chamber to thereby substantially close the passage through the chamber between the front wall of the chamber and the front face of the flap member. The dimensions of the chamber and the rigid and flexible portions of the flap member as well as the positions in which the flap member portions are attached within the suction chamber, will in combination determine the rate and intensity of interruption of fluid flow through the chamber.

When the suction pump is activated, it causes a flow of fluid through the chamber and primarily through a first passage between the front face of the flap member and the front wall of the chamber. The flow through this passage will cause the flap member to be drawn to a position in close proximity or contact with the front wall of the chamber. This action will substantially close the first passage, substantially interrupt the flow of fluid through the first passage, and cause a quantity of water to impact a front face of the flexible portion of the flap member. Restricted flow of fluid will occur between a side of the flexible portion and a wall of the chamber and then via a second passageway between a rear face of the flap member and a rear wall of the chamber. In this manner, the flexible portion acts as a baffle to water flow through the second passageway. Simultaneous with the interruption of fluid flow, the action of the pump will cause a lower fluid pressure zone in the suction hose and in the volume of the chamber downstream of a flexible portion of the flap member. The impact of fluid on the front face of a flexible portion and the lower pressure impinging upon the rear face of a flexible portion of the flap member each cause the flexible portion to deflect towards the lower pressure zone. This action upon and of the flexible portion will apply leverage to the rigid portion and cause the rigid portion and remainder of the flap member to pivot away from the front wall of the chamber, thereby reopening the passage for fluid to be drawn through the chamber. This sequence of events is repeated for as long as the pump is in operation, and causes an automatic reciprocating movement of the rigid portion of the flap member and a regular interruption in fluid flow through the suction chamber for providing a forward movement of the pool cleaner along the surface to be cleaned.

In a preferred embodiment, the flexible portion comprises two lengths of resilient rubber-like material separately mounted closer to the chamber entrance end and attached to or in close proximity to the rear wall of the suction chamber. This arrangement provides a volume between the two flexible portions and the walls of the chamber. The sides of the flexible portions are in close proximity with at least two walls of the chamber thereby enabling the flexible portions to perform as baffles and restrict the flow of water from said volume and the flow passage through the chamber. At least one aperture in a section of the wall of the chamber may be provided to allow, when the cleaner is submerged in a liquid, communication between water contained in said volume and water outside of the chamber. During operation of the device, this arrangement provides a buffer zone of relatively higher pressure impinging on one face of each length of flexible portion, the other face of each such flexible portion being in contact with water at a lower pressure as it is drawn through the chamber towards the hose and suction pump. This arrangement significantly diminishes the propensity of water-borne debris to become lodged between a side of a flexible portion of the flap member and a wall of the chamber which would impair operation of the flap valve.

Sealing means is attached to the rigid portion of the flap member to minimize the flow of water between the sides of a rigid portion and the walls of the suction chamber. The head of the cleaner is connected to surface engaging means such as a detachable shoe suitable for engaging the surface to be cleaned and for supporting the head. To improve the ability of the cleaner to orient the surface engaging means against the surface to be cleaned, floats and weights are attached to parts of the cleaner. To improve the suction grip of the cleaner to the surface to be cleaned, a flexible sealing flange is detachably connected to the shoe. In a preferred embodiment, at least one aperture is provided in the sealing flange such that water and debris may be drawn through the aperture from the upper surface of the sealing flange and then into the entrance end of the suction chamber proximate the surface to be cleaned.

To enable the cleaner to maneuver away from obstacles, the cleaning head may be rotatably attached to the ground engaging means. Automatic means are provided to continuously or intermittently positively rotate at least a portion of the body of a swimming pool cleaner in at least one direction relative to the surface engaging means of the cleaner. Yet further, means are provided to automatically rotate the body of a swimming pool cleaner in a first direction and then another direction relative to the surface engaging means of the cleaner.

To assist the steering, improve maneuverability of the cleaner and help avoid the establishment of repetitive courses across the surface to be cleaned, the sealing flange includes at least one out of round side and/or finger and/or stiffening means suitable for engaging a swimming pool wall or obstacle while the surface engaging means are engaged with the floor of the swimming pool.

BRIEF DESCRIPTION OF THE DRAWINGS

A preferred embodiment, as well as alternate embodiments, of the invention is described by way of example with reference to preferred embodiments in which:

FIG. 8 is a partial perspective view of a top rear portion of the present invention;

FIG. 9 is a partial cross section and exploded view illustrating a removable housing top wall feature of a preferred embodiment;

FIGS. 14A and 14B–18A and 18B are side and top views of five alternate embodiments of a flap useful within the flow control valve, respectively of the present invention;

FIG. 23A is a top plan view of a sealing flange in accordance with the present invention;

FIGS. 23B and 23C are cross section views taken through 23B—23B and 23C—23C, respectively of FIG. 23A;

FIG. 24A is a top plan view of a sealing flange in accordance with the present invention;

FIGS. 24B and 24C are ross section views taken through 24B—24B and 24C—24C, respectively of FIG. 24A;

DETAILED DESCRIPTION OF PREFERRED EMBODIMENTS

Figure 1:
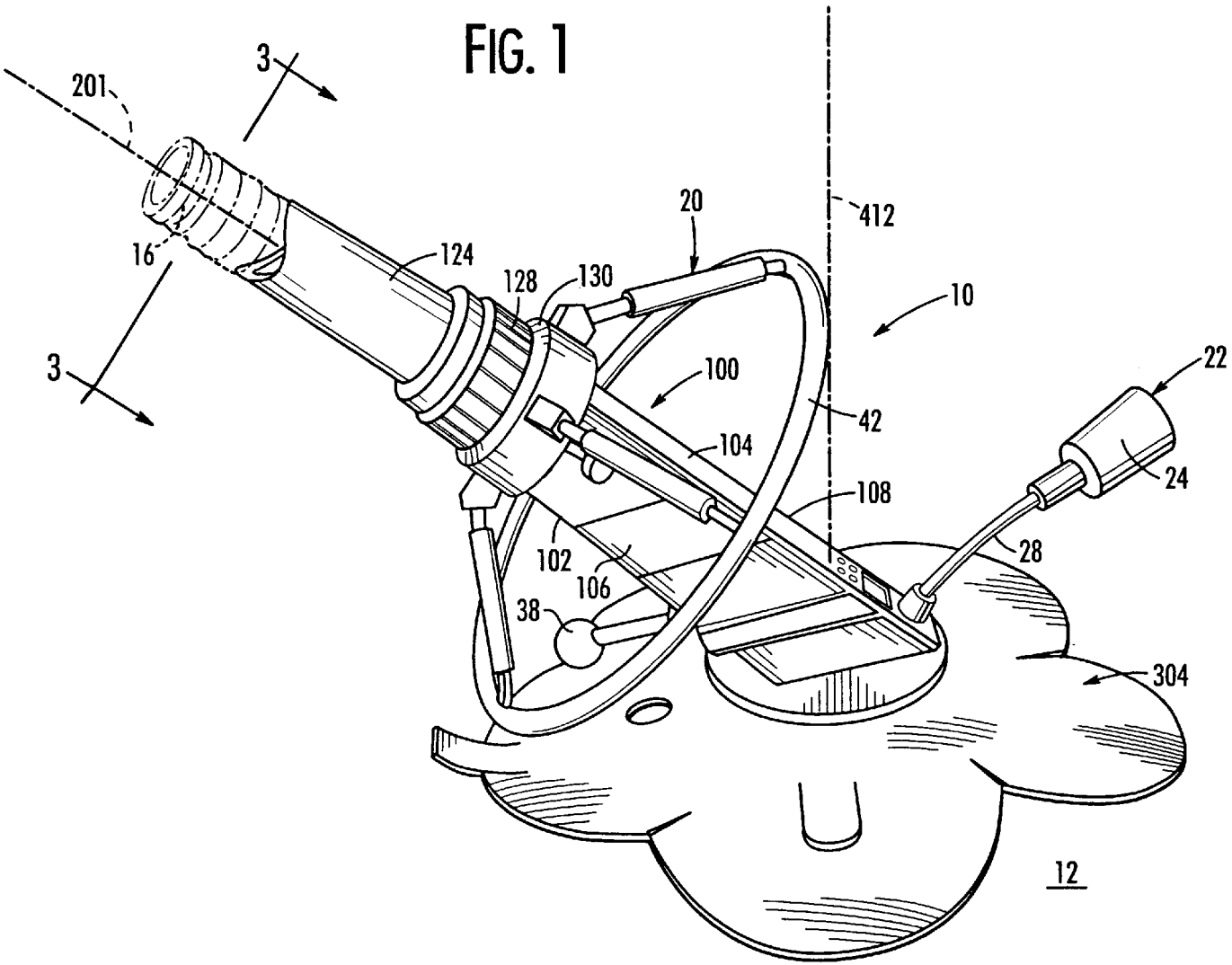
FIG. 1 is a perspective view of a swimming pool cleaner according to the present invention operative within a swimming environment.
Figure 2:
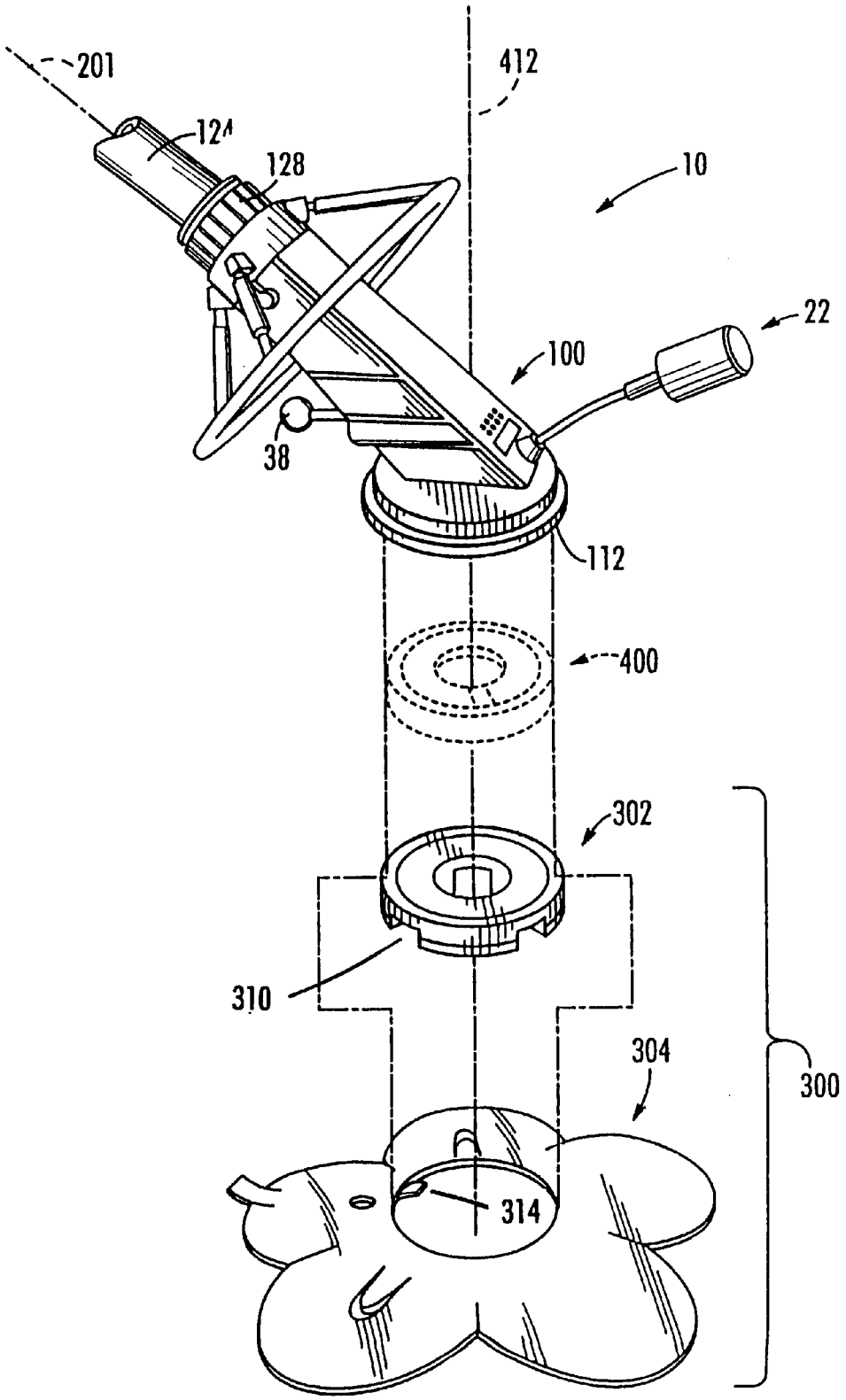
FIG. 2 is an exploded perspective view of the embodiment of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

As initially described with reference to FIGS. 1–4, a swimming pool cleaning device, the pool cleaner 10, for automatically cleaning a surface 12 submerged in liquid 14 comprises a forwardly inclined housing 100 having rigid walls 102, 104, 106, and 108 forming a flow passage or chamber 110 extending therethrough from an inlet or entrance end 112 which in use is proximate the surface 12 to be cleaned, to an outlet or exit end 114 for connection to a flexible suction hose 16. A flow control valve 200 is operable within the chamber 110. Surface engaging means 300 comprises a shoe 302 carried by the housing 100 at the inlet 112 for engaging the surface 12 of a pool 18 to be cleaned. A flexible planar member, herein after referred to as a sealing flange 304 extends around the shoe 302. When in use, the shoe 302 and sealing flange 304 engage the surface 12 to be cleaned. In an alternate embodiment of the present invention, steering means 400 is carried by the housing 100 and is operable therewith for rotating the housing 100 about the surface engaging means 300, the shoe 302 and the sealing flange 304, as will herein be described in further detail.

Figure 5:
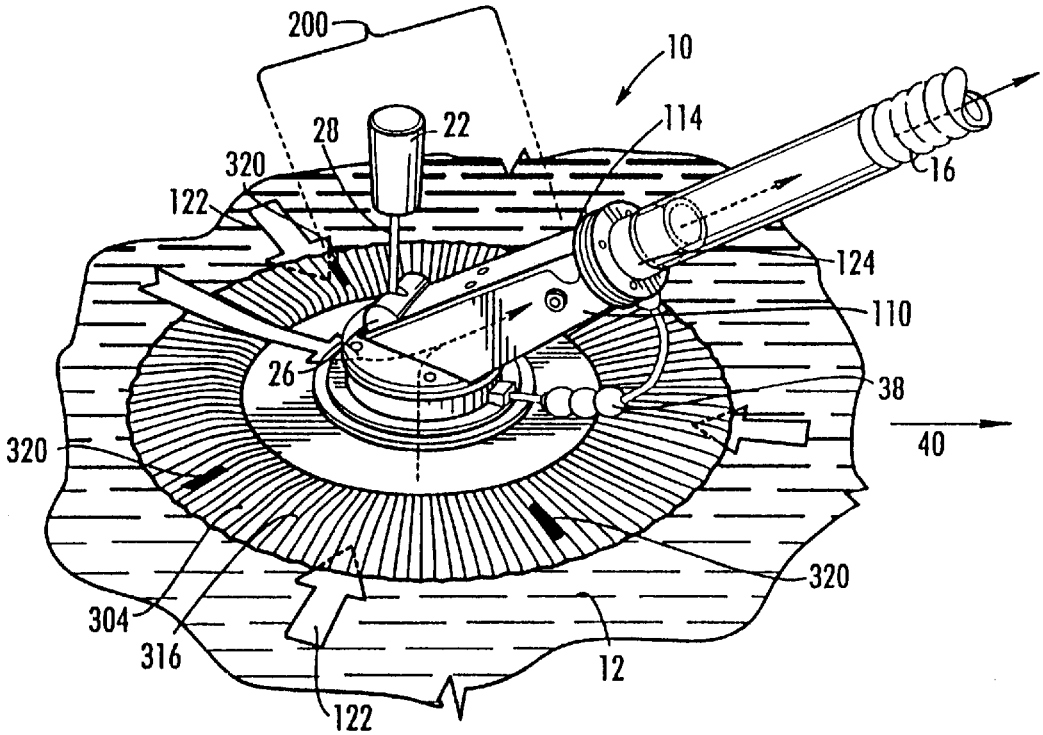
FIG. 5 is a forward top perspective view of an alternate embodiment according to the present invention.
Figure 6:
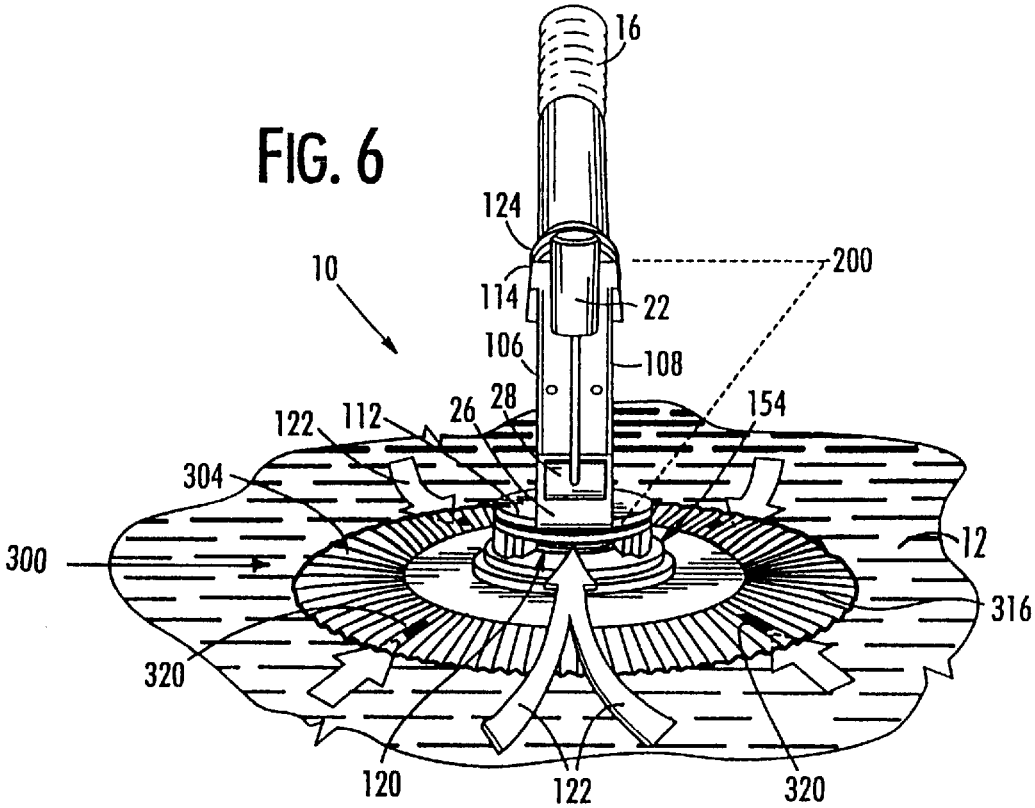
FIG. 6 is a top rear perspective view of the embodiment of FIG. 5.
Figure 7:
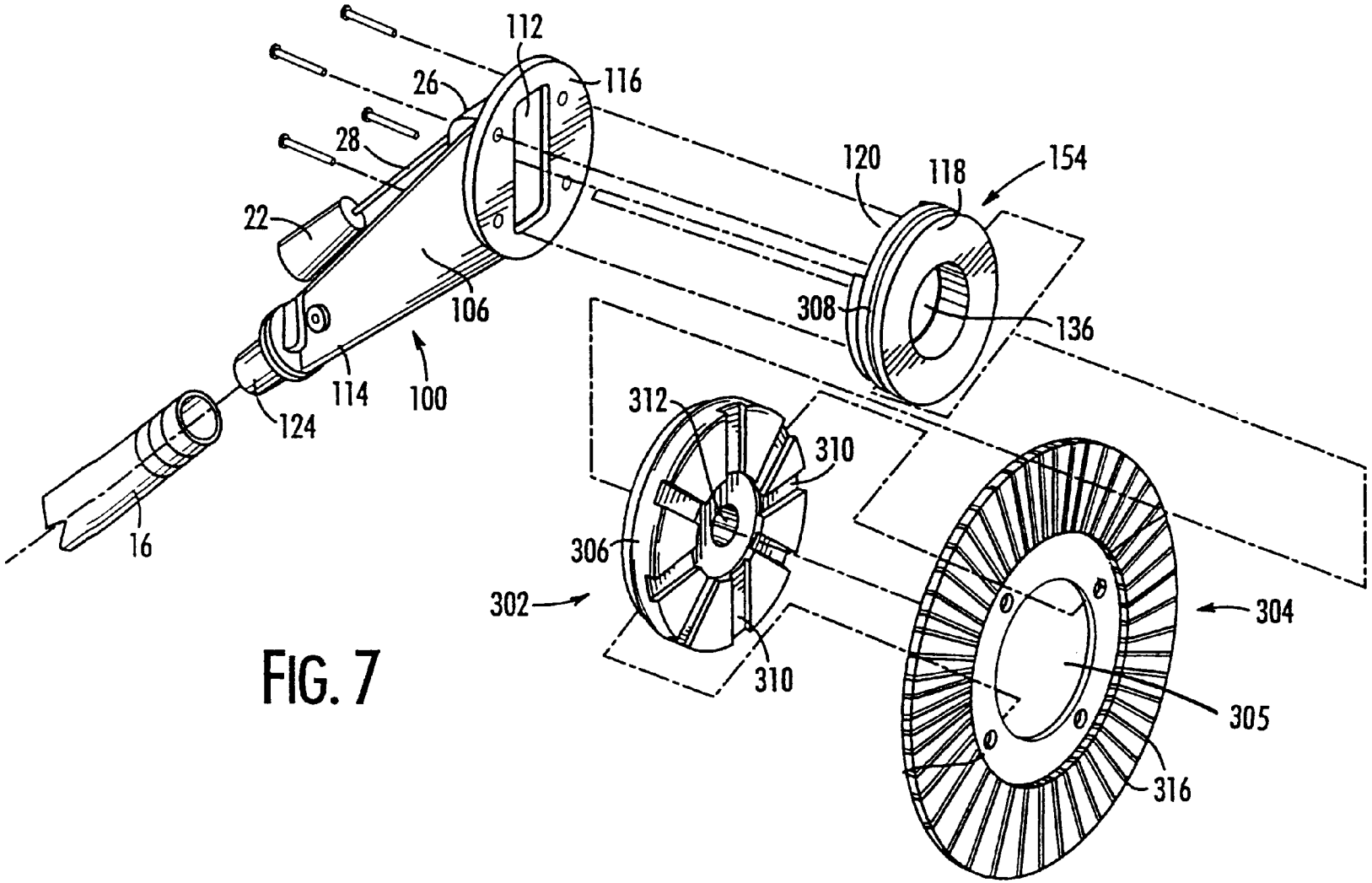
FIG. 7 is an exploded perspective view of the embodiment of FIG. 5.

As described, the water interruption type pool cleaner 10 according to the invention includes the flow control valve 200 communicating with the housing 100 and the shoe 302 with which the cleaner 10 engages the surface 12 to be cleaned. In a second embodiment, and with reference to FIGS. 5–7, a foot 118 is attached to the housing 100. A flange 116 is formed around the entrance end 112 of the housing 100 to facilitate attachment of the housing 100 to the foot 118.

In the preferred embodiments, the sealing flange 304, manufactured from flexible, resilient rubber-like material and incorporating a central opening 305 is attached to the shoe 302.

As illustrated with reference again to FIG. 3, at least one inlet 120 to the housing 100 is in communication with the entrance end 112 and an exit end 114 of the suction chamber 110 to provide fluid flow 122 through the suction chamber 110 and into a flexible hose 16.

As illustrated again with reference to FIGS. 1-7, the flexible hose 16 is connected to the cleaner 10 by means of a hose coupling 124 in communication with the exit end 114 of the housing 100 carrying the flow control valve 200. In one preferred embodiment, to facilitate the turning of the cleaner 10 about an axis 126 extending through the hose coupling 124 and the flow control valve 200, the coupling 124 is rotatable. As illustrated with reference again to FIGS. 2 and 3, the hose coupling 124 incorporates a nut 128 for attaching the coupling 124 to the exit end 114 of the housing 100. Washers 130 reduce friction during rotation of the hose coupling 124 about the axis 126. An annular recess 132 is formed between the nut 128 and the exit end 114 to facilitate attachment of devices such as a deflector to the cleaner or bumper 20.

As illustrated with reference again to FIGS. 2, 3 and 7, the shoe 302 comprises a resilient, flexible, rubber-like material and is attached to the foot 11 8 by engagement of a retaining lip 306 with a recess 308 located substantially around the perimeter of the foot 118 of the FIG. 7 embodiment or housing entrance end 112 in FIG. 3. To provide fluid access to the suction chamber 110, the foot 118 incorporates an opening 136 and the shoe 302 includes grooves 310 and an opening 312.

In one preferred embodiment, as illustrated in FIG. 1, the sealing flange 304 does not rotate relative to foot 118 or shoe 302. At least one locating tab 314 (illustrated with reference to FIG. 2) engages with a cooperating groove 310 or notch within recess 308 to orient the sealing flange 304 in a desired position as illustrated with reference again to FIG. 2. The sealing flange 304 increases the suction grip of the shoe 302 to the surface 12, assists with the cleaning action, helps the cleaner 10 move through the curved transitions between floors and walls of the pool 18, and helps maintain adherence to the walls of a pool. Alternate means of attaching the shoe 302 or sealing flange 304 may be employed without departing from the functions of the foot 118, shoe 302 and sealing flange 304.

With reference again to FIGS. 5 and 6, the peripheral region of the sealing flange 304 in one embodiment has corrugations 316 such that it may be resiliently extended to more easily conform with the shape of the surface 12 to be cleaned and thereby more effectively maintain a suction grip against the surface 12.

In the preferred embodiment as illustrated with reference again to FIG. 3, fluid flow 122, illustrated with arrows, indicate the passageways for fluid flow 122 to enter suction chamber 110. Fluid is drawn towards the foot 118 of the cleaner through at least one fluid intake aperture 318 in the sealing flange 304, and from between the sealing flange 304 and the surface to be cleaned 12. The liquid 14 then travels into the chamber 110 via the groove 310 and the opening 312 of the shoe 302, and via the opening 136 through the foot 118. The suction necessary to induce fluid flow 122 through the housing 100 helps to bias it toward and in contact with the surface 12 to be cleaned. Dirt particles and other debris such as leaves and twigs are thus carried by the fluid flow 122 through the cleaner 10 and into the attached flexible hose 16 towards the swimming pool's pump and filtration system. As illustrated again with reference to FIG. 3, at least two independent inlets 120 from the surface side and a rear wall inlet 138 to the chamber 110 are desirable to help avert possible damage to the cleaner and suction pump system in the event a single passageway become blocked. In particular, the multiple independent inlets 120,138, by way of example, will help avoid personal injury should a single inlet be blocked by part of a person's body.

As illustrated with reference again to FIG. 3, a valve 140 is fitted to the cleaner 10 to regulate the flow of fluid through the inlet 138. The valve 140 comprises a flexure or spring loaded member placed at least partially across the opening of inlet 138 so that the member will deflect in response to decreased pressure in the chamber 110 and thereby allow a greater volume of fluid to enter the chamber 110.

Figure 3:
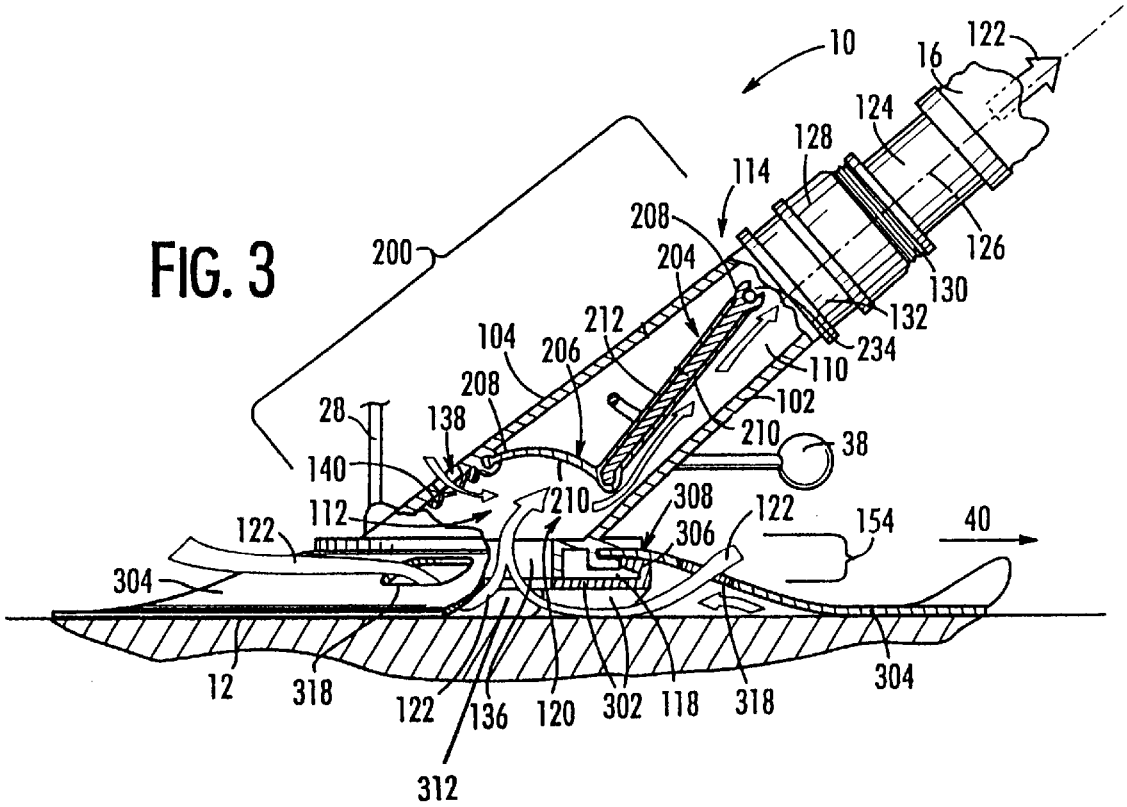
FIG. 3 is a partial cross section view of the embodiment of FIG. 1, illustrating a fluid flow through the embodiment of FIG. 1.

In the preferred embodiment herein shown with reference to FIG. 3, the primary route of fluid flow 122 into the chamber 110 is via the fluid intake aperture 318 in the sealing flange 304 and thereafter through the openings 136, 312 at the inlet 120 in what will be referred to as the operating head 154, which inlet is located between a lower surface of the sealing flange 304 and the surface 12 to be cleaned. The greater fluid flow 122 between the sealing flange 304 and the surface 12 to be cleaned improves the ability of the cleaner 10 to lift dirt and debris from the surface 12 to be cleaned.

Typically, apertures are found in the sealing flanges of many cleaners. However their function is not that of a primary route by which liquid 14 will enter the cleaner. Rather, their function is to sufficiently reduce the suction between the sealing flange and the surface to be cleaned to allow the cleaner to travel more effectively over the surface to be cleaned. The fluid intake aperture 318 within the sealing flange 304 of the present invention provides improved removal of debris and thus improved cleaning of the surface 12.

By way of example, and with reference again to FIGS. 5–7, the primary inlet 120 for fluid flow 122 to enter into the entrance end 112 of housing 100 extends above an upper surface of the sealing flange 304. The inlet 138 is also provided through the opening 136 in the foot 118.

Figure 4:
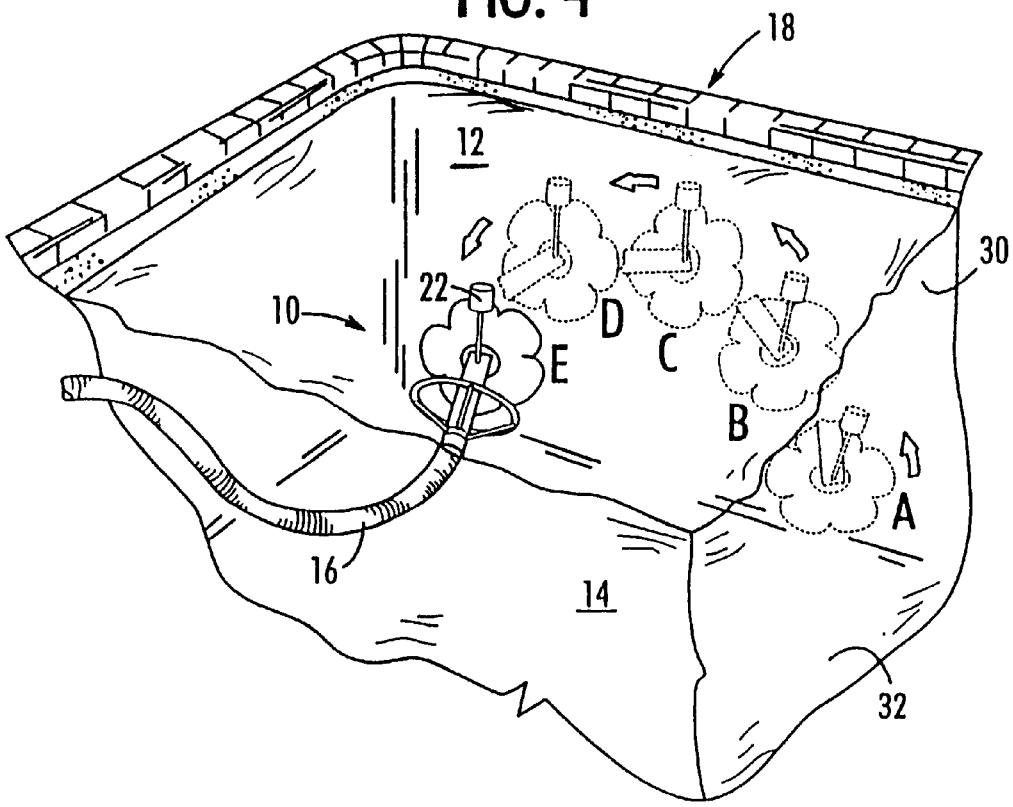
FIG. 4 is a partial perspective view of the invention used in a swimming pool environment.

As illustrated with reference again to FIGS. 2, 4 and 7, to assist the foot 118 or shoe 302 of the cleaner 10 to make contact with the surface to be cleaned 12 in a desired attitude, e.g. where the plane formed by the underside of the foot 118 or shoe 302 is generally parallel with the plane formed by surface 12 in contact with the foot 118 or shoe 302, a buoyancy member 22 comprises a float 24 hingedly attached to the top side or rear wall 104 of the cleaner 10. As illustrated with reference to the embodiment of FIG. 5, a hinge 26 is attached to a top wall of the flow control valve 200, preferably at the base of the rear wall 104. As illustrated with reference to FIG. 1, a flexible stem 28 is used. As illustrated with reference again to FIG. 4, the buoyancy member 22 and its range of movement relative to its point of attachment to the cleaner 10, assists the cleaner 10 to change its direction of travel away from the surface of the fluid. By way of example, when the cleaner 10 is against a vertical wall 30 of the swimming pool 18, the buoyancy member 22 urges the cleaner 10 to turn and travel towards the floor 32 of a swimming pool. With the buoyancy member 22 attached at the base of the rear wall 104, as the cleaner 10 travels up a wall 30 of a swimming pool, the point of attachment will be urged toward that portion of the flow control valve 200 closest to the surface of the water. This action, as illustrated in FIG. 4 by the series of cleaner positions A through E and in turning the cleaner toward the floor 32. The orientation of the buoyancy member 22 relative to the rest of the cleaner 10, particularly when the cleaner itself is in a certain position relative to the surface 12 to be cleaned (e.g. against a wall 30), is adjusted through preferred geometric shapes 34 incorporated into the hinge 26 as shown in FIG. 8. Interaction between the shape 34 and the stem 28 of the buoyancy member 22 controls the position of the buoyancy member 22.

As illustrated with reference again to FIGS. 1 and 3, a weight 38 attached near the base of a front wall 102 of the flow control valve 200, compliments the action of a buoyancy member 22 to turn the cleaner 10 traveling across a wall 30 of a swimming pool by urging the front wall 102 of the cleaner 10 to turn towards the floor 32 of the swimming pool. The weight 38 may be used without the buoyancy member 22.

To further assist the cleaner in attaining a desired attitude, additional weights are attached to the housing of the cleaning apparatus. With reference again to FIGS. 5 and 6, one embodiment includes multiple weights 320 located on and around the peripheral region of the sealing flange 304. Further, in lieu of or in addition to attached weights 320, density increasing additives such as Barium Sulfate may be incorporated into the materials forming the cleaner 10; particularly the sealing flange 304, shoe 302, or foot 118.

Figure 11:
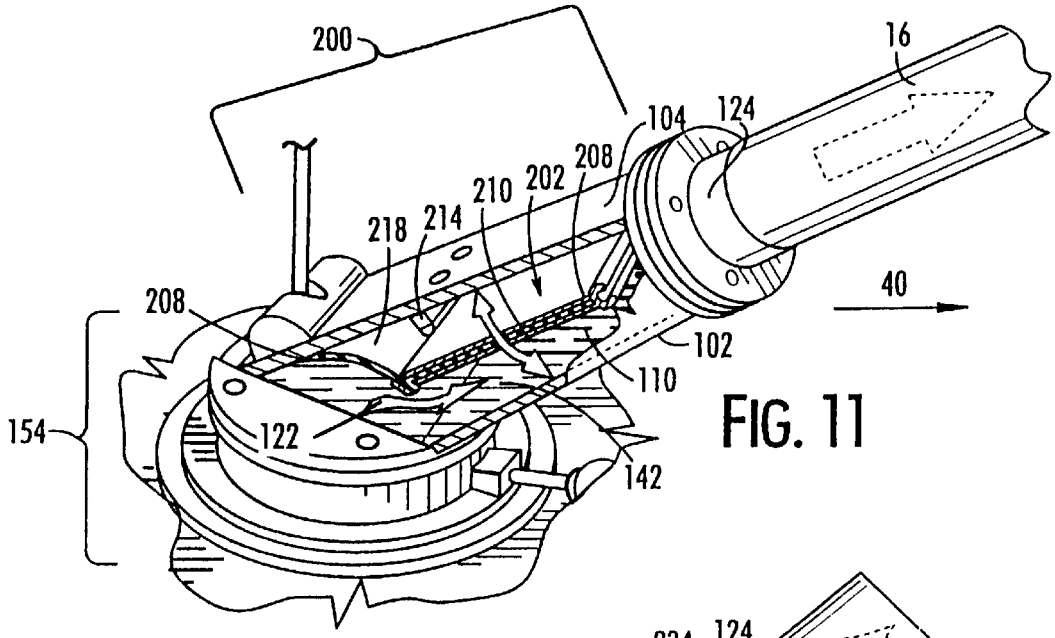
FIG. 11 is a cut-away top perspective view illustrating a fluid flow through the flow passage.
Figure 12:
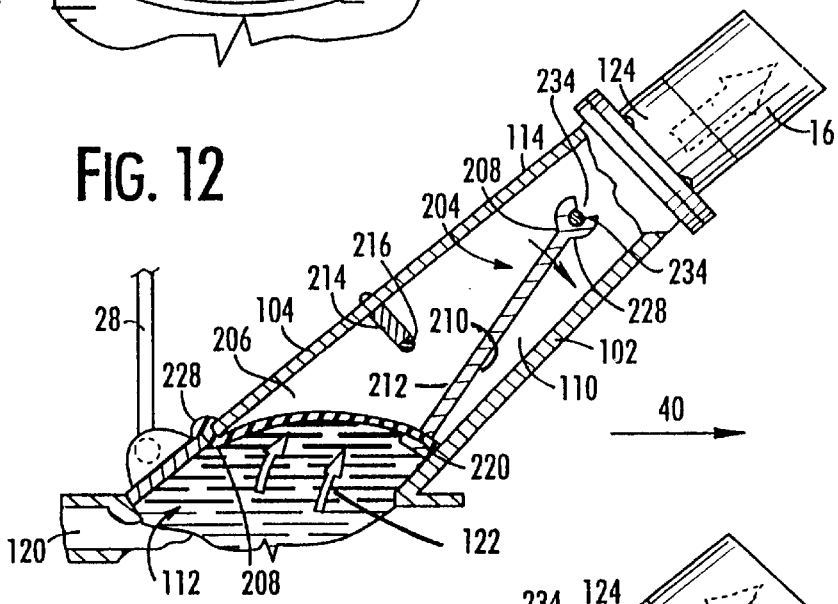
FIGS. 12 and 13 are side cut-away views illustrating the flow passage with the flow control valve in a seated position, stopping flow, and in an unseated position, permitting flow, respectively.

As earlier described and with reference again to FIG. 3, the suction chamber 110 is located between and communicates with the operating head 154 and the hose coupling 124 to provide a fluid passage through the cleaner 10. In operation, the suction chamber 110 comprises the entrance end 112 in proximity to the submerged surface 12 to be cleaned and an exit end 114 connected to the hose coupling 124. As illustrated with reference to FIGS. 11–13, the housing 100 and thus the suction chamber 110 can be described as having two sides 108 and 106 the front wall 102 and the rear wall 104. The front wall 102 is generally lateral to the direction of travel indicated by arrows 40. As illustrated again with reference to FIG. 3, the axis 126 of the passage through the suction chamber 110 is angled in a forward direction of travel 40 with respect to the surface 12 to be cleaned. Further, as illustrated with reference to FIG. 9, the top/rear wall 104 is detachable.

As illustrated with reference again to FIG. 3 and FIGS. 9–13, a flap member 202 is mounted within the suction chamber 110 and includes at least one substantially rigid portion 204 joined to at least one flexible portion 206. The flap member 202 comprises at least two ends 208, at least two sides, a front face 210 and a rear face 212. In a preferred embodiment, the flexible portion 206 comprises a single piece of resilient rubber-like material. Alternately, the flexible portion 206 may comprise multiple elements in a cooperative or hinged arrangement designed to perform the function of the flexible portion 206 as illustrated with reference to FIGS. 18A and 18B.

Each end 208 of the flap member 202 is pivotally mounted between two sides 108 and 106 of a suction chamber 110 about axes which are generally transverse to the flow of liquid through the suction chamber 110. As illustrated with reference to FIG. 14B, the flap member 202 and the chamber 110 in which it is mounted are dimensioned such that at least two sides 210 of the flap member 202 remain in close communication with the sides 108 and 106 of the chamber 110. As illustrated with reference again to FIGS. 3, 9, 11, and 13 illustrate that the substantially rigid portion 204 of the flap member 202 is pivotally mounted closer to the exit end 114 of the chamber 110 and in spaced relation to both the front and rear walls 102 and 104. The flexible portion 206 of the flap member 202 is mounted closer to the chamber entrance end 112 and attached to or in close proximity to the rear wall 104 of the chamber 110. At least a portion of the flap member 202 must be capable of travel into a position of close proximity or contact with the front wall 102 of the chamber 110 to thereby substantially restrict flow there through or close a first passage 142 through the chamber 110.

The ends 208 of the flap member 202 incorporate attachment means 228 which will facilitate simple attachment and detachment of the flap member 202 into the chamber 110. FIGS. 9–13 illustrate the use of a C-clip to attach an end 208 of the rigid portion 204 to a shaft 31 fitted between the sides 108 and 106 of the chamber 110. FIG. 9 illustrates the detachable rear wall (or lid) 104 and the flap member 202 in an exploded view detached from the chamber 110. The detachable wall 104 includes a hook 144 at the entrance end 112 and a tongue/suction clip 146 at the exit end 114 for removably attaching the wall 104 to the chamber 110. The tongue 146 is held in position by a portion of the nut 128. Easy access is provided to the interior of the chamber 110 for removal of debris, replacement of the flap member 202, and other maintenance tasks without the need for tools. Other means of attachment may be employed to attain the benefits of this invention.

Figure 13:
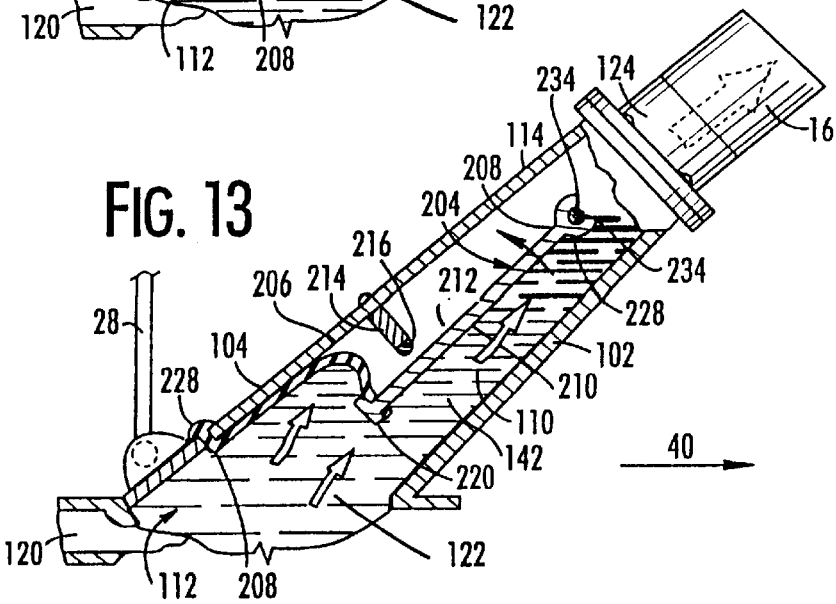

In operation, and as illustrated with reference again to FIGS. 11 through 13, when the suction pump is activated, it causes fluid flow 122 through a first chamber 110 and primarily through a passage 142 between the front face 210 of the flap member 202 and the front wall 102 of the chamber. The fluid flow 122 in the first passage 142 will cause the flap member 202 to be drawn towards, and may cause a portion of the flap member 202 to make contact with the front wall 102 of the chamber 110, as illustrated with reference to FIG. 12. This action will substantially restrict or interrupt the fluid flow 122 through the passage 142 and cause a quantity of water to impact a front face of the flexible portion 206 of the flap member 202. Restricted fluid flow 122 will occur between a side 210 of the flexible portion 206 and a side wall 108, 106 of the chamber 110 and then through a second passage 148 between a rear face 212 of the flap member 202 and a rear wall 104 of the chamber 110. In this manner, the flexible portion 206 act as a baffle to fluid flow 122 through the second passage 148. Simultaneous with the interruption of fluid flow 122, the action of the pump will cause a lower fluid pressure zone in the suction hose 16 and in the second passage 148 of the chamber downstream of a flexible portion 206 of the flap member 202. The impact of fluid on a front face of the flexible portion 206 and the lower pressure impinging upon a rear face 212 of a flexible portion 206 of the flap member 202, each cause the flexible portion 206 to then deflect towards the lower pressure zone of second passage 148. This action upon and of the flexible portion 206 will apply leverage to the rigid portion 204 and cause the rigid portion 204 and remainder of the flap member 202 to now pivot away from the front wall 102 of the chamber, thereby reopening the first passage 142 for fluid flow through the chamber 110, as illustrated in FIG. 13. This sequence of events is repeated for so long as the pump is in operation, and causes a regular interruption in fluid flow 122 through the suction chamber 110 and an automatic to and fro reciprocating movement of the rigid portion 204 of the flap member 202.

The dimensions of the chamber 110, rigid portion 204 and flexible portion 206 of the flap member 202 and the positions in which the flap member 202 is located within the chamber 110, will in combination determine the rate and intensity of interruption of fluid flow 122 through the chamber 110. It is anticipated that particular rates and intensities of interruption of fluid flow will be suited to particular tasks.

In general, the flow control valve 200 of the present invention is therefore well suited for incorporation into water interruption type swimming pool cleaners as a means for providing a propulsive force. As disclosed in the prior art and by Chauvier in U.S. Pat. No. 4,023,227 and Raubenheimer in U.S. Pat. No. 3,803,658 in particular, sudden interruption of the fluid flow 122 through the chamber 110, transfers the kinetic energy which had been developed by the fluid flow 122 as an impulsive force. In this case, the energy is transferred to the flap member 202 and thus cause the suction chamber 110, which in a preferred embodiment is angled in a forward direction, to travel in that direction with respect to the surface 12 to be cleaned. The kinetic energy transferred to the angled suction chamber 110 will have a vertical component and a horizontal component, the horizontal component being in the direction of the arrow 40, as illustrated by way of example in FIGS. 11–13. The interruption in fluid flow 122 also causes the flexible hose 16 to jerk. Further, the suction against the surface 12 to be cleaned is momentarily reduced each time that the fluid flow 122 is halted or restricted, thereby decreasing the frictional engagement of the foot 118, shoe 302, and sealing flange 304 against the surface 12. This impulsive force, hose jerk and reduction in frictional engagement is sufficient to displace the cleaner 10 and travel across the surface 12 to be cleaned in the direction of the arrow 40.

It should be noted that during operation of the flow control valve 200 one wall of the chamber 110 may be impacted more vigorously by a portion of the flap member 202 than the opposite chamber wall. As illustrated with reference again to FIG. 12, the front wall 102 of a preferred embodiment is impacted by the flap member 202 in the general region of the connection between a rigid portion 204 and a flexible portion 206. The force of the latter impact is greater than the occurrence as described earlier with reference to FIG. 13, which reveals that when the flap member 202 moves towards the rear wall 104, the surface area of the flexible portion 206 in close proximity or contact with the rear wall 104 will progressively increase which, together with resistance occurring upon flexing or hinging of the flexible portion 206, will cushion the force applied against the rear wall.

In preferred embodiments, the flap member 202 is mounted within the chamber 110 in a manner such that the particular wall of the chamber 110 which, upon interruption of fluid flow 122 is impacted more forcefully by a portion of the flap member 202, is the front wall 102. This will enable the horizontal component of the force with which the flap member 202 impacts the front wall 102 to complement the horizontal component of the force derived from the interruption of fluid flow 122, and thus enhance the forward displacement of the cleaner 10 across the surface 12.

It has been found that the flow control valve 200 will operate and provide propulsive force even when fluid flow 122 through the chamber 110 is weak, for example, because of a low capacity pump, dirty filters, or other factors which are well known in the industry. The same flow control valve 200 has also been found to operate effectively at the other, higher, end of the fluid flow 9 spectrum usually experienced within the swimming pool industry. With lower fluid flow 122, the rigid portion 204 will reciprocate to and fro through a lesser arc than it will with greater fluid flow. The greater the arc, the greater the opening to the primary passage 142 through the chamber 110 between the front wall 102 and the flap member 202, consequently allowing a greater volume of fluid and debris to pass through the chamber.

As illustrated with reference again to FIGS. 11–13, the arc and rate of reciprocating movement of the rigid portion 204 may be governed by the placement of a limiting means or stop 214 between a wall 104, of the chamber 110 or housing 100 and a face of the flap member 202. A buffer 216 of rubber-like material is attached to the limiting means 214 or to the wall 104,102 in an alternate arrangement.

In a preferred embodiment, the rigid portion 204 of the flap member 202 is manufactured using a substantially rigid plastic material. The flexible portion 206 is manufactured from a softer, flexible, resilient, plastic or rubber-like material. The hardness of the flexible material is typically between 40 and 90 using the Shore A Durometer scale. To help avoid tears, the flexible material may be reinforced with flexible ribs 218, as illustrated with reference to FIGS. 17A and 17B, and/or fibers, cloth or other suitable means.

Figure 10:
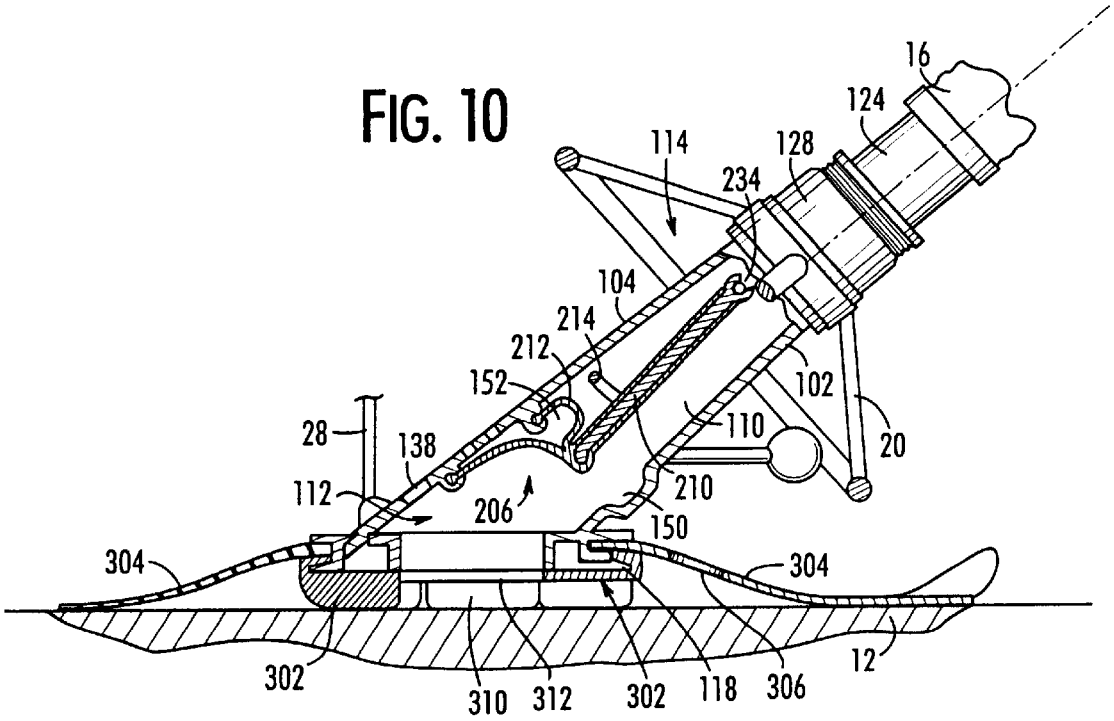
FIG. 10 is a partial cross section view illustrating an alternate embodiment of a flow control valve in accordance with the present invention.
Figure 10A:
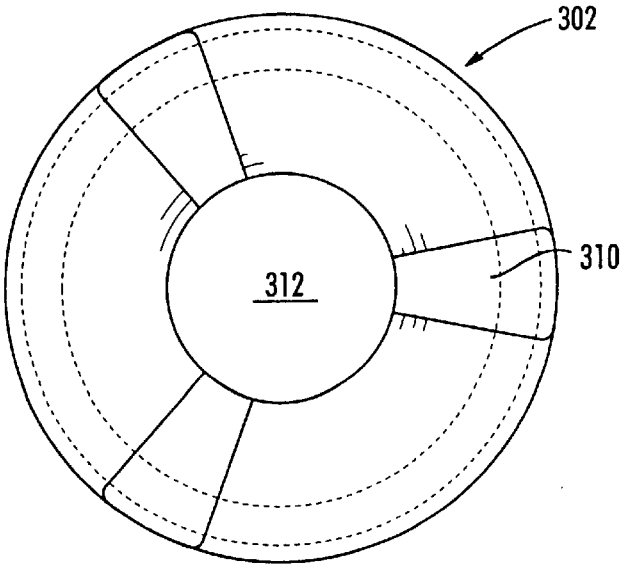
FIG. 10A is a top plan view of a show in accordance with the present invention.

A fluid flow seal 220 is provided in the general area of the connection between the rigid 204 and flexible portions 206, as illustrated in FIGS. 14A–18. Upon contact or proximity with the front wall 102 of the chamber 110, the fluid flow seal 220 will substantially interrupt fluid flow 122 through the chamber 110. Preferably, in order to buffer the impact of the seal against a wall 102, the seal 220 may be manufactured from an impact absorbing material such as a resilient plastic or rubber-like material or incorporate an impact absorbing buffer 222 as shown, by way of example, in FIG. 18A. As shown in FIG. 10 an impact absorbing buffer 216 may also be attached adjacent the front wall 102. While the noise emitted by the subject invention is significantly less than that emitted by interruption-type pool cleaners typically found in the art, the use of the seal 220 made with an impact absorbing material or the inclusion of the buffers 216, 222 will further reduce the noise emitted by contact between the seal 220 and the front wall 102. Buffers 216, 222 will also reduce the possibility of wear and damage to the cleaner 10 caused by repetitive impacts of the flap member 202 against a wall of the cleaner 10.

In another preferred embodiment illustrated with reference to FIGS. 20 and 21, a recess 150 is provided in the front wall 102 of the chamber 110 to receive seal 220 when the flap member 202 is drawn towards the front wall 102. The recess 150 is preferably oversized relative to the seal 220. With this arrangement, it has been found that the seal 220 need not make contact with the front wall for fluid flow 122 to be sufficiently interrupted to provide the force for propelling the cleaner 10. Yet further improvement in lower noise levels is achieved and the cleaner is less prone to trap and hold debris between the wall 102 and the seal 220.

As earlier described, dirt particles and debris such as leaves and twigs will be drawn by the fluid flow 122 into and through the chamber 110 and flexible hose 16 towards the swimming pool filtration system. As illustrated with reference again to in FIGS. 14A, 14B, and 20, to optimize the function of the flow control valve 200, the dimensions of the flap member 202 and the chamber are proportioned to minimize fluid flow 122 between a gap 226 formed between the edges 210 of the flap member 202 and the sides 108, 106 of the chamber 110. A small gap 226 will minimize fluid flow 122 there through, but has the disadvantage that dirt and debris often become lodged in the gap 226. To help prevent the entrapment of dirt or debris in the gap 226, the sides 210 of the rigid portion 204 are dimensioned to be further away from the chamber sides 108, 106, is attached to at least a portion of the rigid portion 204 to extend substantially across the gap 226. The flexible edge seal 224 will flex to allow larger pieces of dirt or debris to pass through the gap 226.

Figure 20:
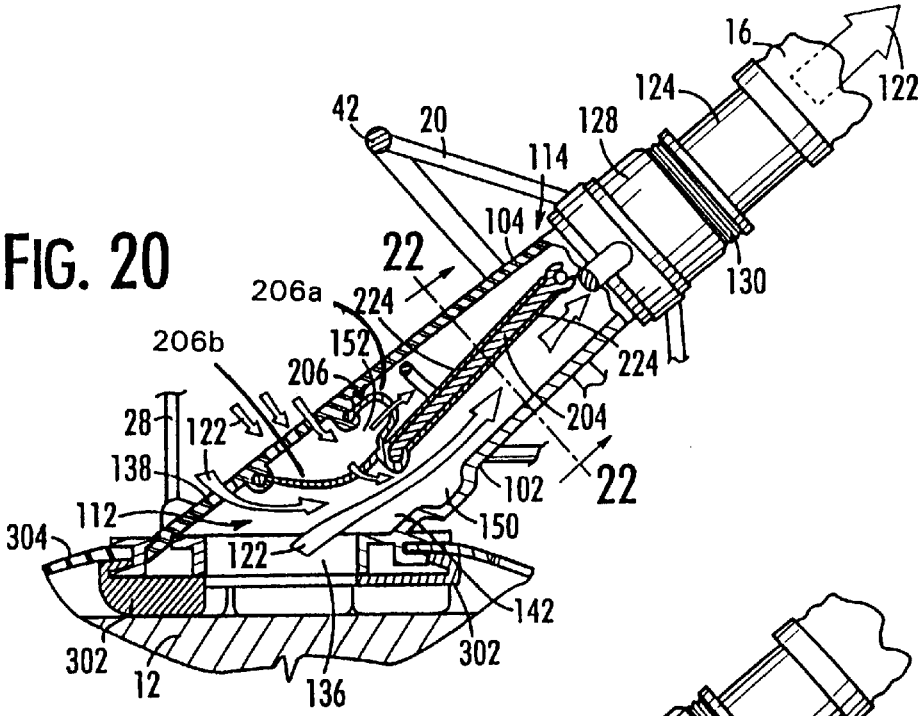
FIGS. 20 and 21 are cross section views through the flow passage illustrating seated and unseated positions of an alternate embodiment of the flap in accordance with the present invention.
Figure 22:
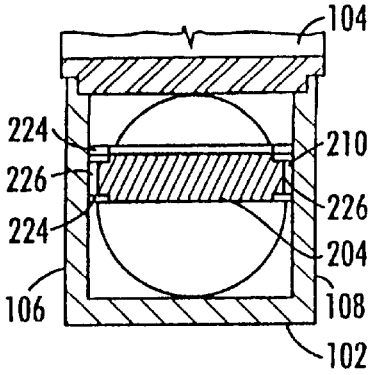
FIG. 22 is a cross section view taken through lines 22—22 of FIG. 20.

FIGS. 20 and 22 illustrate more than one seal 224 attached to a side 210 of the rigid portion 204 of the flap member 202. This preferred embodiment provides a buffer of water sandwiched between the seals 224 and further reduces the possibility of entrapment of debris in gap 226 due to seepage of fluid flow between passageways 142 and 148.

Figure 14A:
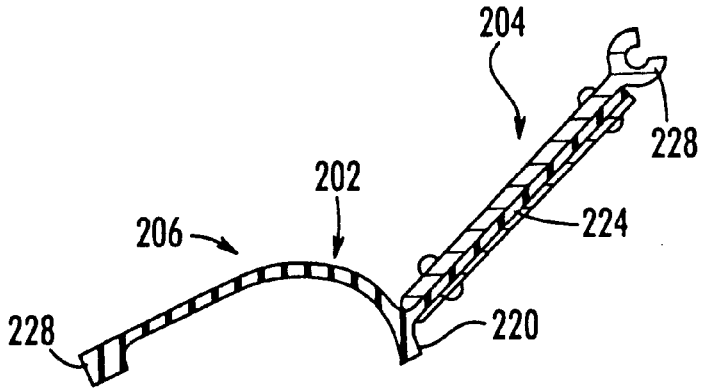
Figure 14B:
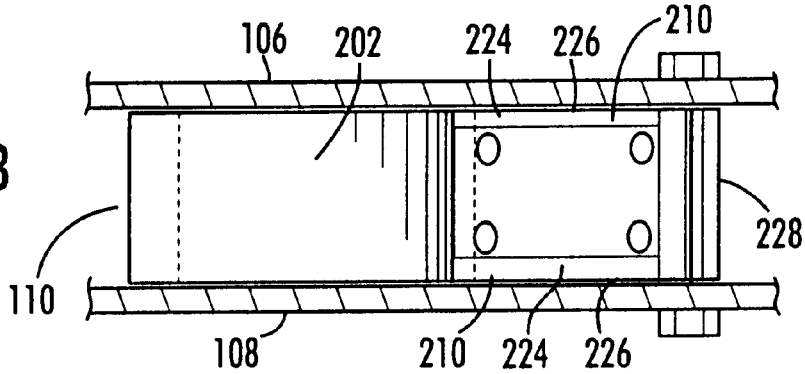
Figure 18A:
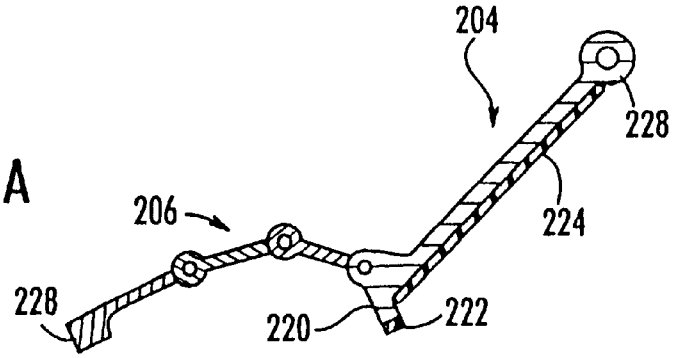
Figure 18B:
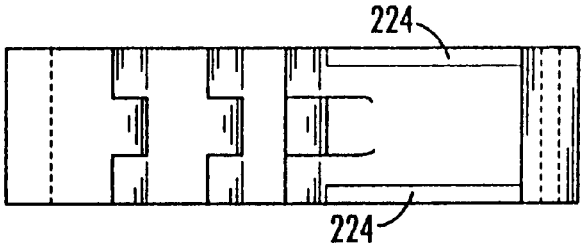

In the embodiment shown in FIGS. 9, 14A, and 14B, the edge seal 224 is formed as an integral part of the flexible portion 206 of the flap member 202, and extends towards the end 208 of an attached, narrower, rigid portion 204. Alternately, as illustrated in FIGS. 18A and 18B, the edge seal 224 may be a separate part attached to the flap member 202, usually the rigid portion 204.

Figure 17A:
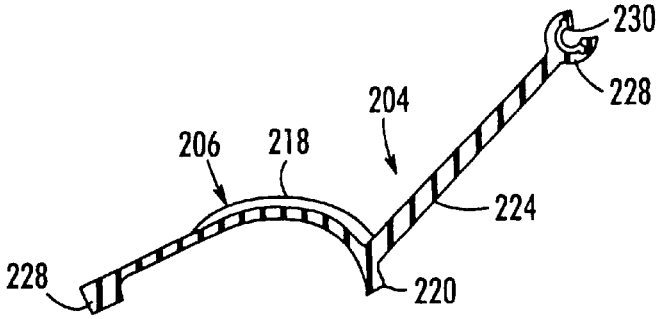
Figure 17B:
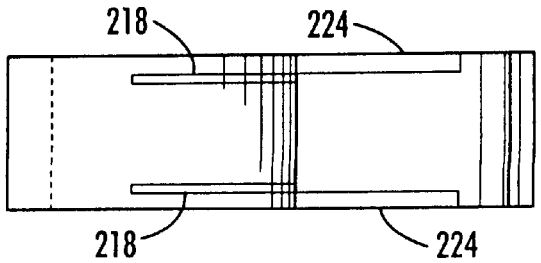

FIGS. 15A, 15B, 17A, and 17B illustrate embodiments of the flap members 202 where the rigid portion 204, the flexible portion 206 and the edge seals 224 are integrally formed from the same rubber-like material, and where the flexible portion 206 and the edge seals 224 are thinner than the rigid portion 204, thereby achieving the necessary rigidity and flexibility of the respective elements. FIGS. 17A and 17B illustrate the use of at least one rib 218 to achieve reinforcement or stiffening as may be required for desired operation of the flow control valve 200.

Figure 15A:
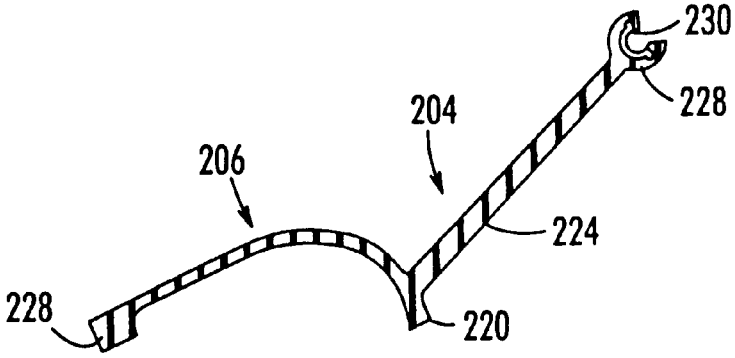
Figure 15B:
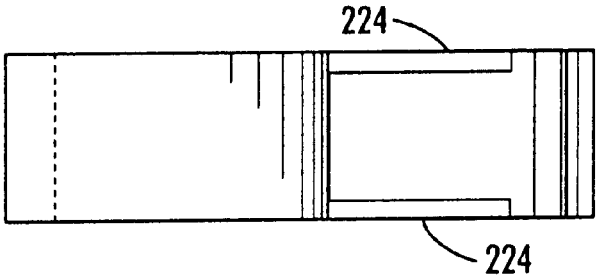
Figure 16A:
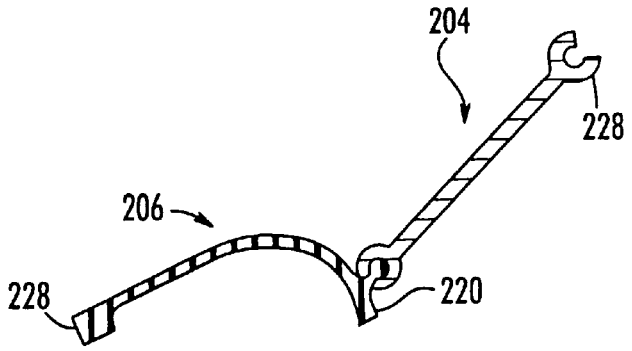
Figure 16B:
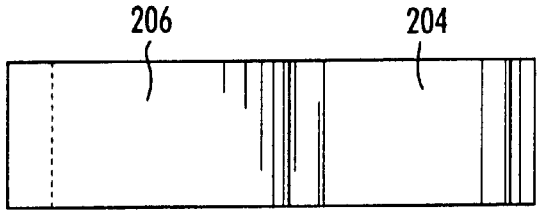

At least one bushing 230 may be incorporated into an attachment means 228, as in FIGS. 15A and 17A, for example.

Figure 19A:
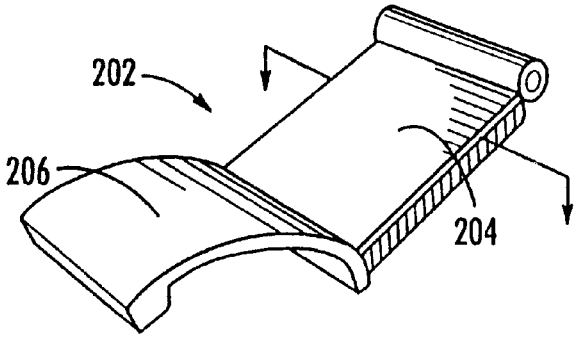
FIGS. 19A–19C are perspective and cross section views illustrating alternate seals for the flap.
Figure 19B:
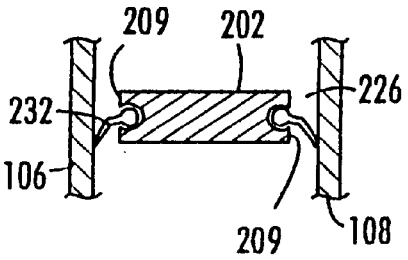
Figure 19C:
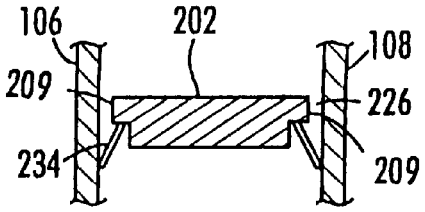

In addition, by way of example, a sliding seal of the type disclosed by Sebor in U.S. Pat. No. 5,371,910 may be incorporated into the flap member 202. Further with reference to FIGS. 19A and 19B, a seal 232 may be pivotally attached along the edge of at least one side edge 209 of the flap member 202 in an alternate embodiment of the present invention. FIG. 19C illustrates a flexible, resilient seal 234 attached at an angle to and outwardly extending from the edge of the flap member 202.

As illustrated with reference again to FIGS. 20 and 21, a flap member 202, in an alternate flap embodiment, includes multiple flexible portions 206*a*, 206*b* separately mounted closer to the chamber entrance end 112 and attached to or in close proximity to the rear wall 104 of the suction chamber 110. This arrangement provides at least one buffer of water in a third or additional passageway 152 located between the passages 142 and 148. This buffer of water in passageway 152 and the action of the additional flexible portion 206 significantly diminishes the propensity of water-borne debris to become lodged between a side 210 of a flexible portion 206*a*, 206*b* of the flap member 202 and a wall 108, 106 of the chamber 110 which would impair operation of the flap member 202.

Figure 21:
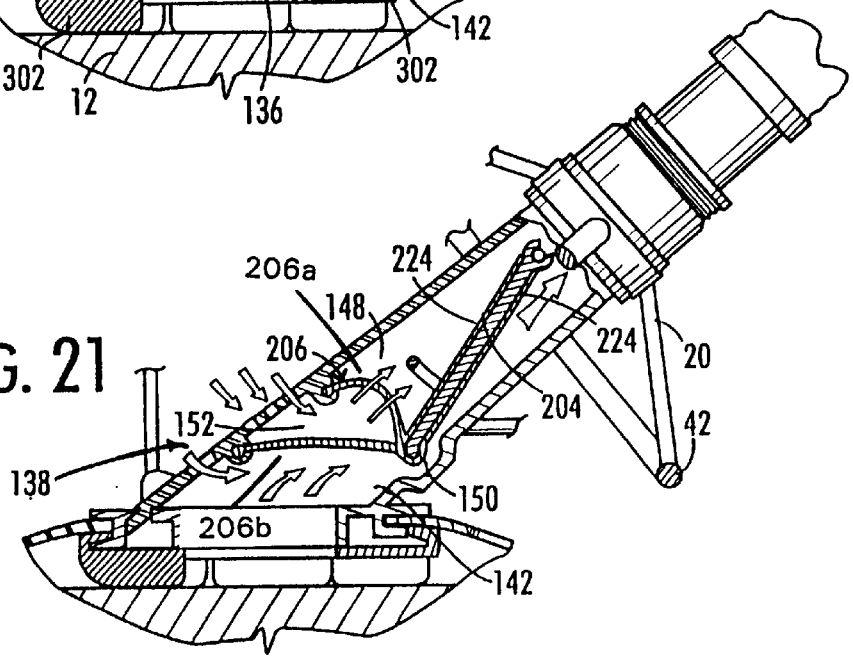

As illustrated in FIGS. 20 and 21, one flexible portion 206*b* will separate flow passages 142 and 152, while another flexible portion 206*a* will separate flow passages 152 and 148. This means that only one of the two flexible portions 206*b* is in direct contact with debris-laden fluid flow 122 entering passageway 142. The sides of the flexible portions 206*a*, 206*b* are in close proximity with at least two walls 108, 106 of the chamber 110, thereby enabling the flexible portions 206*a*, 206*b* to perform as baffles and restrict the flow of water from the volume of water in passageways 152 and the flow passages 142 and 148. At least one aperture (inlet 138) in a section of the wall 104 of the chamber 110 is provided to allow, when the cleaner 10 is submerged, water to enter directly into passageway 152, which will usually carry significantly less debris than water drawn into passageway 142 of the cleaner 10 via the operating head 154.

During operation of the cleaner 10, the pressure in passageway 148 will always be lower than in passageway 152. Consequently, some of the water in the passageway 152 (which separates passages 142 and passageway 148 ) will seep between a side 209 of a flexible portion 206 and the wall 108 or 106 of the chamber 110 into the passageway 148. This occurrence avoids seepage of debris-laden water around the side 209 of a flexible portion 206 from the passage 142 into passage 148. When the passage 142 is open, as illustrated in FIG. 20, the pressure in that passage 142 and passage 148 will be lower than in passageway 152. Consequently, water will seep from the passageway 152 into both passages 142 and 148, thereby preventing debris from the debris-laden water entering passageway 142 from becoming lodged between the wall 108,106 of the cleaner 10 and the side 209 of a flexible portion 206 of the flap member 202. Further, as also depicted in FIG. 20, the flexible member 206 in contact with fluid flow 122 in the passage 142 will be bowed into the stream and present a convex shape less conducive to the entrapment of debris than the concave shape (earlier described with reference to FIG. 3) that would be presented to the fluid flow 122 by embodiments using a single flexible portion 206.

Alternate embodiments for the sealing flange 304 suitable for the cleaner 10 of the present invention which does not employ positive steering means are illustrated with reference to FIGS. 23A–24C. Further, the sealing flanges 304 are intended for use with a cleaner embodiment such as that illustrated in FIG. 3 in which the primary route of fluid intake into the suction chamber 110 is via an intake aperture 318 in the sealing flange 304 The intake aperture 318 is improved by the incorporation of a resilient flap 322 which automatically adjust in response to the flow of fluid through the apertures 318. A resilient flap 322 may be integrally formed with the sealing flange 304 and oriented such that when the cleaner 10 is not in operation, the resilient flap 322 extends into the intake aperture 318 to partially close such aperture 318. To reduce the possibility that the flap 322 become snagged on an obstacle, the free end of the resilient flap 322 is directed rearwardly and to more than 90 degrees from the direction of travel 40 for the embodiments herein described. At least one rib 324 or other suitable stiffening means is integrally formed with the flap 322. At least one rib 326 or other suitable stiffening means is integrally formed with the sealing flange 304 and located, for example where it reduces the flexibility and strengthens a portion of the sealing flange 304.

Figure 25A:
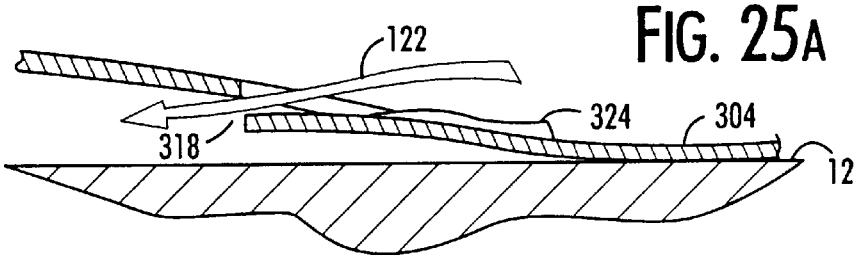
FIGS. 25A and 25B are cross section views taken through 25—25 of FIG. 25A for varying flow strengths.
Figure 25B:
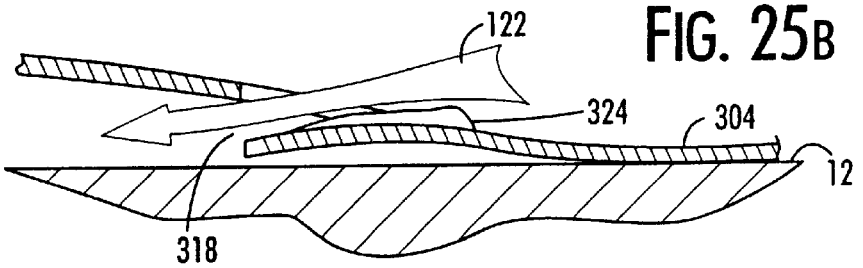
Figure 27:
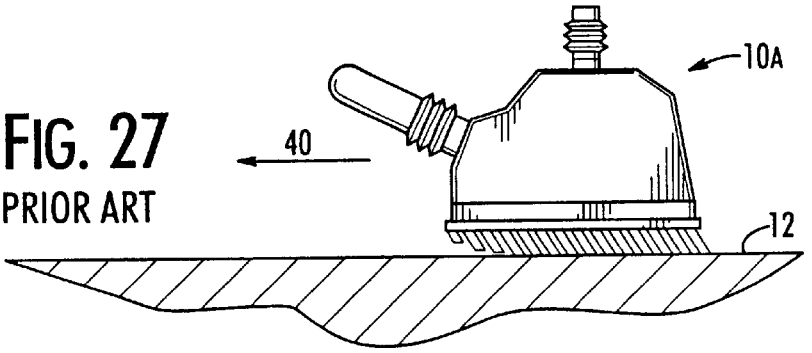
FIG. 27 PRIOR ART
FIG. 27 is a side elevation view of a prior art swimming pool cleaner.

By way of example, and as illustrated with reference to FIG. 23A, during operation of the cleaner, fluid flow 122 will travel across the upper surface of the sealing flange 304 and through the aperture 322 towards the foot 118 as earlier described. The greater the fluid flow 122 through the cleaner 10, the greater the extent to which the resilient flap 322 will flex in response to that flow and thereby increase the cross-sectional area or opening of the aperture 318 to allow more fluid to pass there through as illustrated with reference to FIGS. 25A and 25B. In this manner, the adherence of the sealing flange 304 against the surface 12 to be cleaned will be controlled within a range conducive to optimum cleaner 10 performance. In circumstances where fluid flow 122 is at a lower end of that range usually provided by swimming pool suction pumps, due perhaps to a weaker pump or a dirty filtration system, the flap 322 will flex to a lesser degree and thereby make maximum use of the available suction and flow 122 to adhere the cleaner 10 properly to the surface 12. Conversely, the flap 322 will flex more in circumstances where the suction and flow 122 is stronger and thereby avoid excessive adherence to the surface 12 to be cleaned which would otherwise be detrimental to cleaner operation and inhibit proper movement over the surface 12 to be cleaned. The flexing action is also useful should one intake aperture 318 become partially or fully blocked by, for example, a large leaf. In such a situation, the flap 322 will flex further in response to the greater suction caused by the blockage and, in so doing, may increase the opening sufficiently to allow the leaf to pass through. The flaps 322 will also flex in response to changes in the flow 122 through the groove 310 or grooves in the shoe 302 (described earlier with reference to FIG. 2) due, for example, to undulations in the floor of a swimming pool.

To help the cleaner 10 turn away from an obstacle or small radius transition in a swimming pool, for example a drain cover or where a step joins the floor, it is desirable that the peripheral portion 328 of the sealing flange 304 which typically engages the obstacle or small radius be able to flex to allow the flange 304 and its peripheral portion 328 to move over the obstacle or through the small radius. Since only a portion of the sealing flange will typically come into contact with the obstacle or radius, only a section of peripheral portion 328 of the sealing flange need flex at any one time. It is desirable that a section be capable of flexing independently of the remainder of the sealing flange 304. FIGS. 23A and 24A illustrate flanges 304 which are segmented in a petal-like manner about their peripheries. Except at the rear of the sealing flange, it is preferred that the segmentation or slit not extend a distance greater than half of the distance between an outer extremity of the flange 304 and the opening control 306.

It is also preferred that the sealing flange 304 be fixed in position by suitable means such as the locating tab 314, earlier described. This will ensure that the leading portion 330 cannot rotate relative to the foot 118 of the cleaner 10 and will always point in the direction of travel 40.

Figure 26:
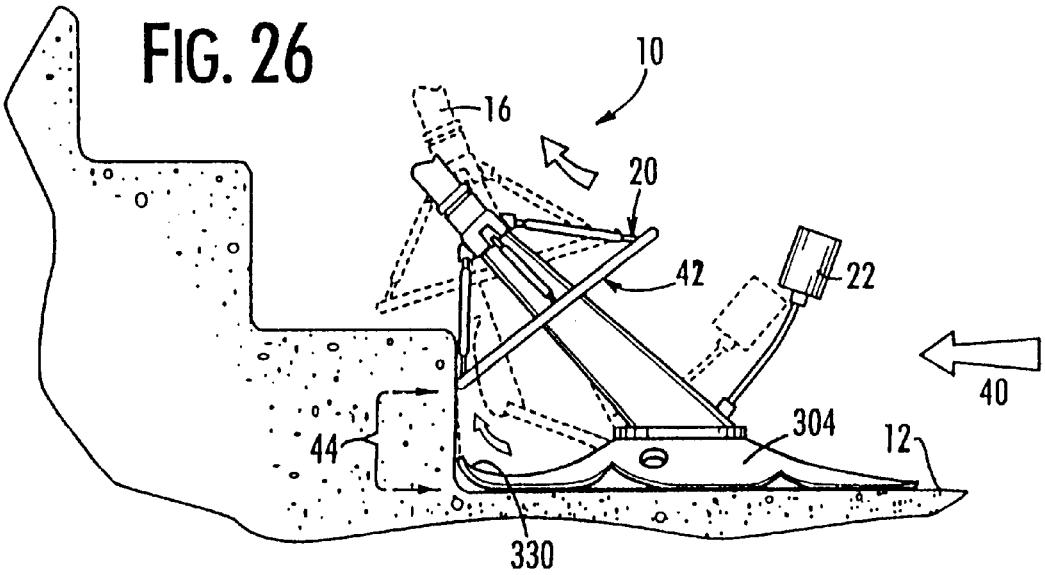
FIG. 26 is a side elevation view illustrating an embodiment of the present invention in use in a swimming pool environment.

In operation, when the leading portion 330 of the sealing flange 304 engages a small radius such as at the base of a step, unless it travels across the radius, there is a chance that the cleaner 10 will not be able to move away from the step. If the leading portion 330 flexes through the radius as illustrated in FIG. 26, the cleaner 10 will travel at least part way up the step and then disengage itself and fall to one side or gradually turn to one side and move away from the area.

The deeper segmentation or slit at the rear of the sealing flange 304 enables two segments to splay apart when the cleaner travels through a small radius to allow the underside of the sealing flange 304 to maintain contact with the surface 12 to be cleaned. This action facilitates good frictional contact with the surface 12 and assists with continued forward propulsion of the cleaner 10. If necessary, the cut or space between the segments may be substituted by a pleat 332, as illustrated in FIG. 24A. This configuration will allow the desired splaying between segments, but will limit the seepage of liquid through the space between segments.

The ability of the leading portion 330 of the sealing flange 304 to flex through a small radius or to pass over obstacles such as drain covers may be further improved by the incorporation of at least one lipped section 334 or at least one fin 336 protruding forward of the outer edge of a leading portion of the sealing flange 304, as illustrated with reference to FIGS. 23 and 24. The shoe 302 may be integrally formed with the sealing flange 304.

The ability of the cleaner 10 to move away from obstacles such as a step is further assisted by the employment of a bumper ring 20, as illustrated with reference again to FIG. 1. In a preferred embodiment, a conical shaped bumper ring 20 is removably and rotatably attached to the cleaner 10 by engagement with the annular recess 132 earlier described with reference to FIG. 3. The bumper ring 20 may be removed without the use of tools by loosening the nut 128. Given equal diameters of the rims in each case, the conical shape is an improvement over a planar ring because, when attached as shown in FIG. 26, the distance 44 of the lowermost portion of the rim 42 above the surface 12 to be cleaned is minimized. This enables the bumper ring 20 to be extended around the chamber 110 and thus hold the cleaner 10 away from obstacles. If appropriate for the conditions in a particular swimming pool, the bumper ring 20 may be inverted to increase the distance 44. The alternate embodiments include the bumper ring 20 made from substantially rigid plastic material and from resilient rubber-like material.

The cleaner 10 described thus far need not employ positive steering means to navigate the surface 12 of the pool to be cleaned. The subject invention includes the ability to either incorporate such means into a flow interruption cleaner, or to provide means to simply attach positive steering to a cleaner 10.

Figure 31:
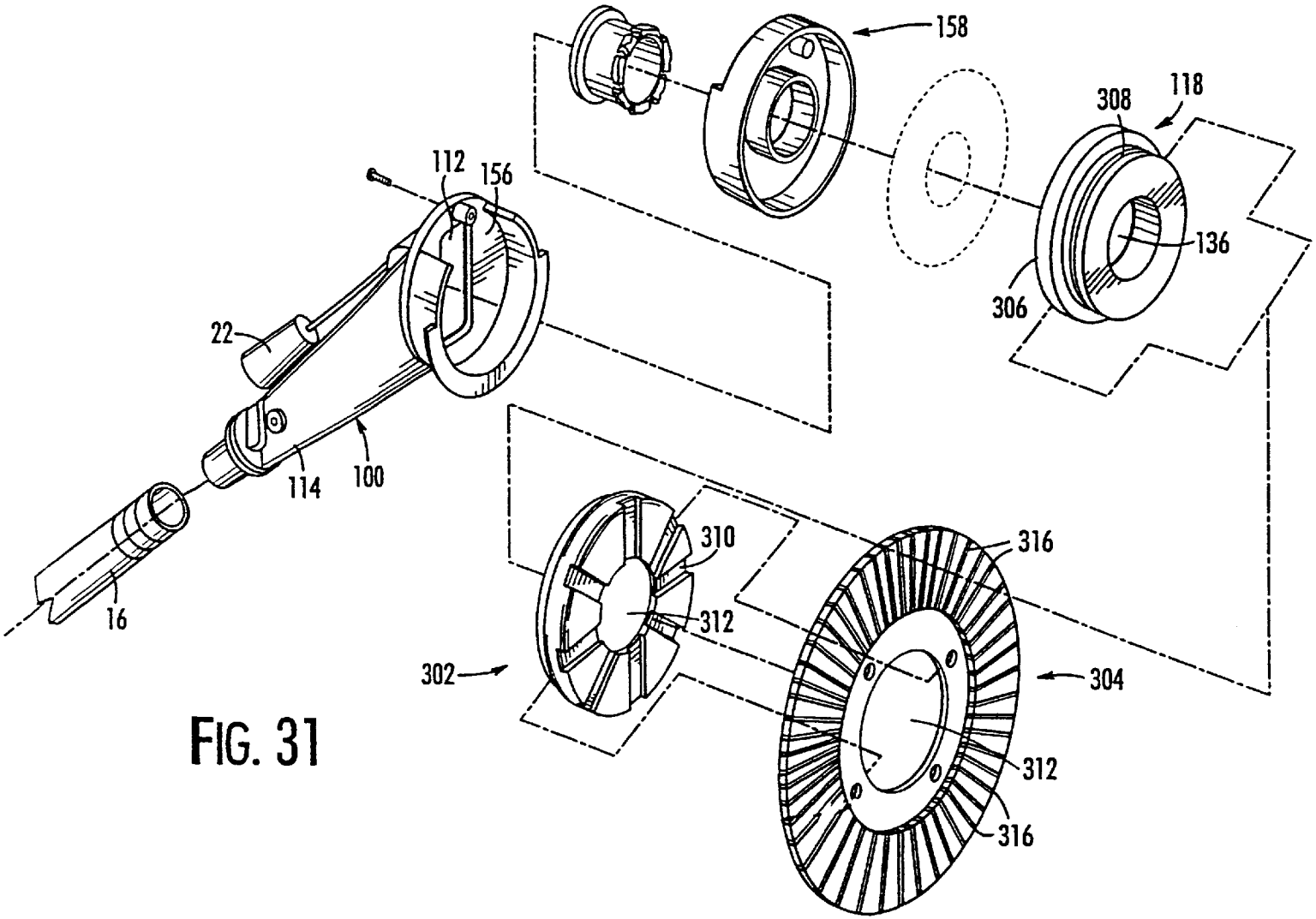
FIG. 31 is an exploded perspective view of the embodiment of FIG. 29.

In order to accommodate steering means, particularly the means disclosed herein, a head 154 of the cleaner 10 is formed from two pieces 156 and 158, each having flanges suited for interlocking connection, as shown in FIG. 31. In a preferred embodiment, the upper piece 156 is formed as an integral part of the housing 100 forming the suction chamber 110. The passageway 120 through the operating head 154 is in communication with the entrance end 112 and exit end 114 of a suction chamber 110 to draw fluid flow 122 from above the foot 118 of the cleaner 10 and into a flexible hose 16, as earlier described.

Figure 29:
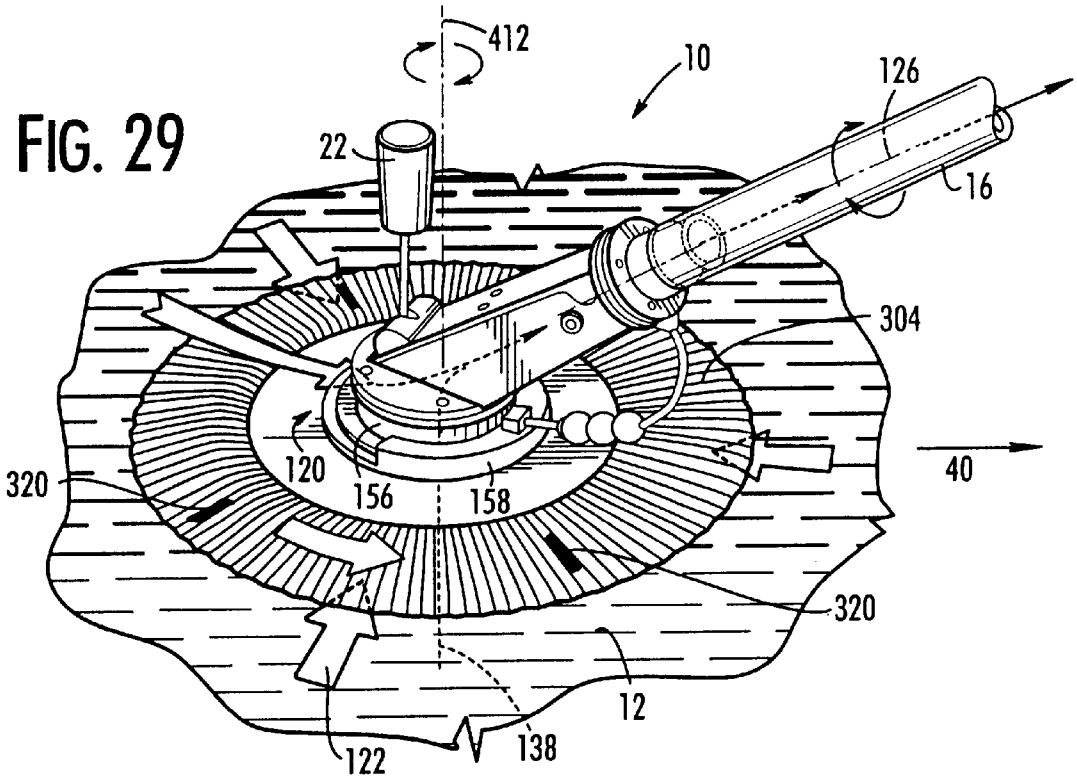
FIG. 29 is a forward top perspective view of an alternate embodiment according to the present invention.
Figure 30:
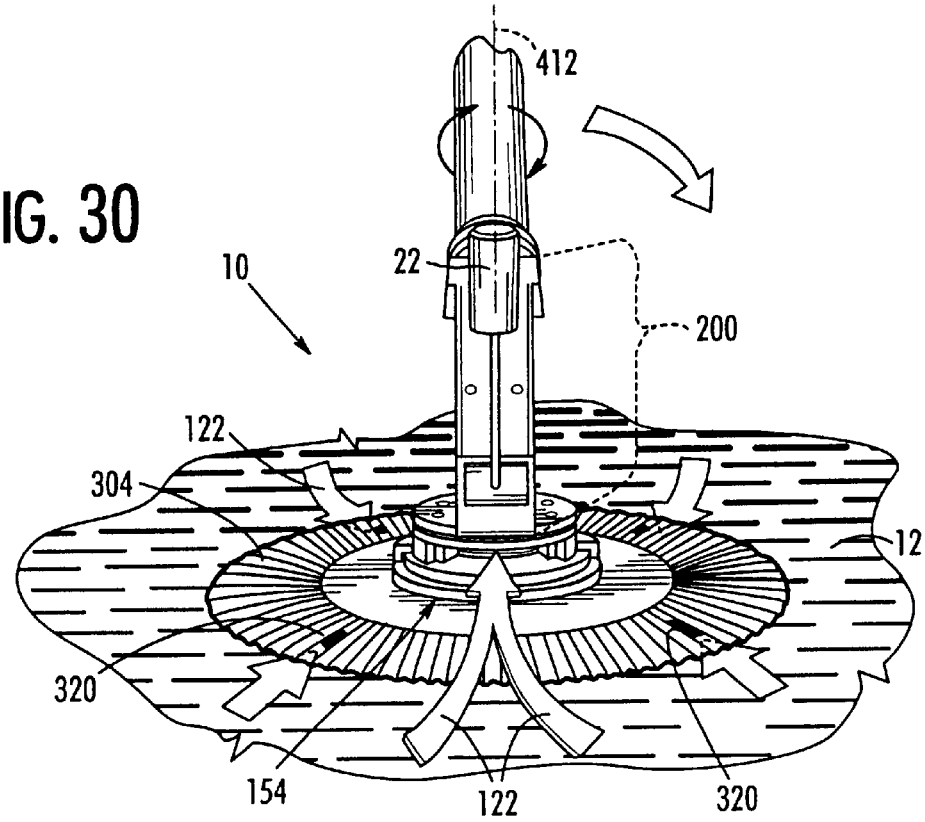
FIG. 30 is a top rear perspective view of the embodiment of FIG. 29.

As again illustrated with reference to FIGS. 29, 30, and 31, the operating head 154 and flow control valve 200 are rotatably connected to and supported by a foot 118 and a resilient shoe 302 with which the cleaner 10 engages the surface 12 to be cleaned. This will enable the operating head 154 and flow control valve 200 to rotate relative to the foot 118 and shoe 302 about an axis 412 substantially normal to the surface 12 to be cleaned and which extends through the center of the foot 118 and shoe 302.

As illustrated again with reference to FIG. 31, a steering means to positively rotate the foot 118, shoe 302 and sealing flange 304 may be accommodated in a position between a lower portion of the operating head 158 and the foot 118 or shoe 302. Embodiments of steering means are disclosed in detail later within this section.

Figure 32:
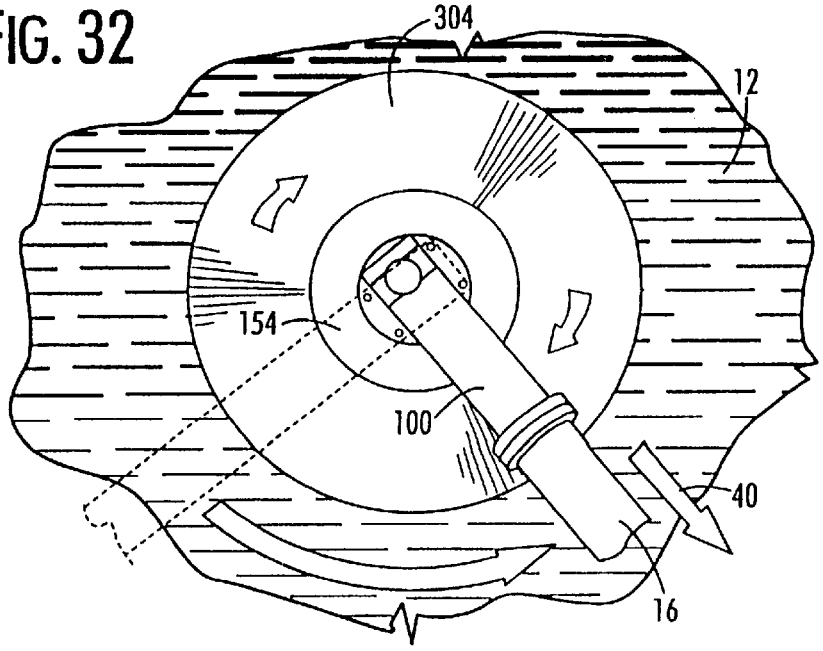
FIG. 32 is a diagrammatic top view of a cleaning device in accordance with the present invention.

FIG. 32 illustrates a cleaner 10 where the grip of the sealing flange 304, foot 118 and shoe 302 against the surface 12 (the foot 118 and shoe 302 are hidden in this view by the sealing flange 304) minimizes or eliminates rotation of those components relative to the surface 12 to be cleaned. The same illustration shows the housing 100, head 154 and flow control valve 200 rotatable about axis 412. This embodiment does not include positive steering means. However, the ability of the head 154 simply to rotate relative to the surface engaging means is by itself sufficient to assist the cleaner 10 to avoid entrapment, for example, in corners of a swimming pool or by obstacles therein.

Flow interruption cleaners 10 having an inclined chamber 110 or housing 100 travel in the general direction 40 in which the hose coupling 124 points. As the cleaner 10 moves, it will push a length of the hose 16 ahead of itself. Consequently, as the length of the hose 16 is pushed towards, for example, the walls or a corner in a swimming pool, the hose 16 will bend and a force will be applied to the coupling 124 of the cleaner 10. This will cause the coupling 124 and cleaner 10 to rotate through an arc relative to its foot 118, other surface engaging means and surface 12 to be cleaned; thus a new course will be established. In cleaners which cannot rotate relative to their surface engaging means, the adherence of the cleaner to the surface 12 makes it more difficult for the hose to bend away early enough to avoid entrapment of the cleaner. The ability of a cleaner of this invention to rotate enables the hose 16 to bend away earlier and consequently the cleaner will follow the new direction indicated by the hose coupling 124.

A free rotating arrangement as described in the previous paragraphs works best in smaller pools where the walls of the pool interact with and alter the orientation of the hose 16. This interaction will help avoid a repetitive travel pattern which may otherwise be established by the cleaner 10. Without frequent interference with the walls to randomly alter the position of the hose, the inherent resilience of the flexible hose 16 eventually directs the cleaner to a position where the hose is generally more relaxed, and the cleaner may adopt a repetitive pattern of travel (typically a figure eight) across the surface 12 to be cleaned. To overcome this limitation, a positive steering means 400 as herein described is provided for the cleaner 10 to positively rotate the cleaning head 154 relative to the cleaner's surface 12 engaging means, which in the above described embodiment is the foot 118, the shoe 302 and the sealing flange 304. The steering means 400 may rotate the cleaning head 154 continuously in one direction only, in one direction intermittently, in opposing directions without an intermittent period between directions, or in opposing directions with an intermittent period between directions. Further, the number of rotations or partial rotations before intermittent disengagement of the steering means in either direction may be varied. The speed of rotation in one or both directions is also controlled.

Figure 33:
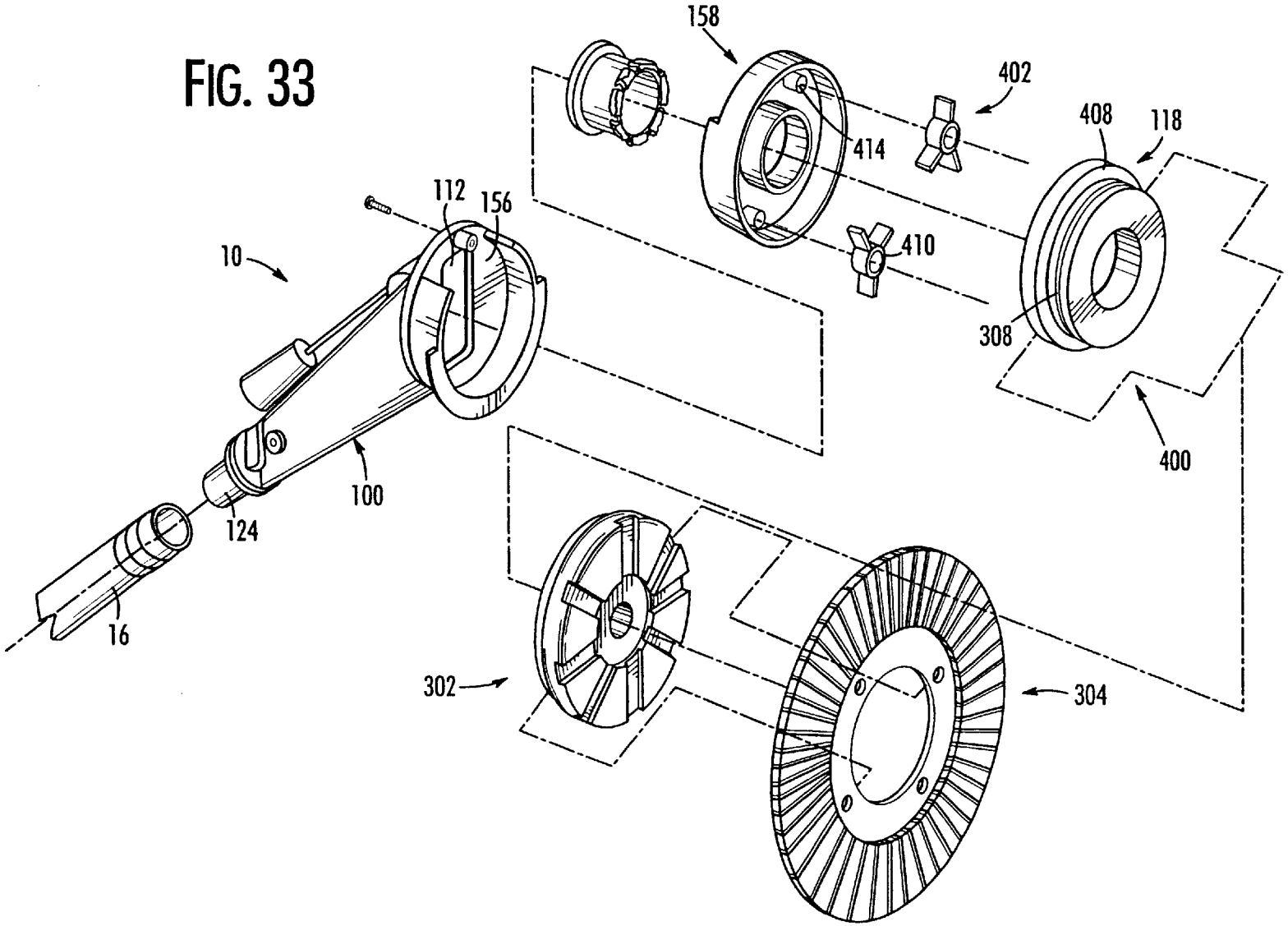
FIG. 33 is an exploded perspective view of an alternate embodiment of the present invention.

As shown in FIG. 33 and FIGS. 34A, 34B, 34C, and 34D, an embodiment of a steering means suitable for incorporation into a cleaner 10 of the water interruption type having an inclined chamber 110, may conveniently be incorporated within an annular chamber 404 formed by the mating of a lower portion of the operating head 158 and a cylindrical portion 408 of the foot 118. As illustrated in FIG. 33, the lower portion of the operating head 158 may include means for easy attachment to another part 156 of the operating head. Other suitable receiving means for attaching positive steering components to the housing 100 of a cleaner 10 include the flange 116 as described earlier with reference to FIG. 6.

The steering means 400 depicted in FIG. 33 and FIGS. 34A, 34B, 34C, and 34D, will enable the housing 100 to rotate in opposing directions with an intermittent period between directions. At least one resiliently biased pawl 402 is mounted to the lower portion 156 of the operating head 154 within the annular chamber 404 and dimensioned such that a free end of the pawl 402 is capable of movement through a limited arc and may obliquely engage a raised portion 406 of the cylindrical wall 408 of the foot 118, but will be spaced away from any portion which is not raised. A suitable means for resiliently biasing the pawl 402 is a tab 410 made from a flexible, resilient plastic material, the free end of such resilient tab 410 being capable of engagement with a portion of or part fixed to a lower portion 158 of the operating head 154. The tab or tabs 410 may be positioned so that when the free end of the pawl 402 is not engaged with a raised portion 406 of the foot 118, the tab or tabs 410 may position the pawl 402 so that it will approximately coincide with a radial extending from the center of the foot 118 towards the cylindrical wall 408. The interior face of the cylindrical wall 408 may incorporate teeth or other means to engage with the free end of the pawl.

Figure 34A:
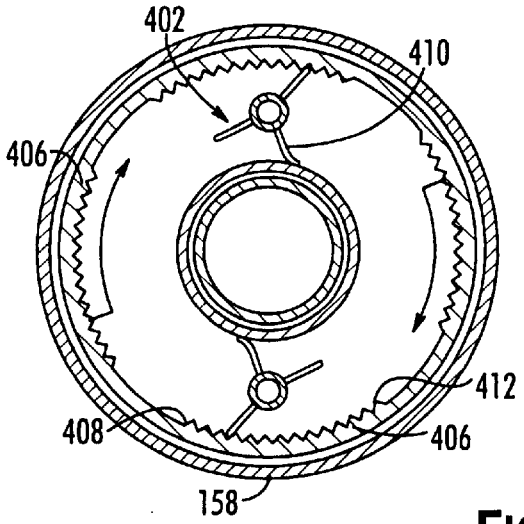
FIGS. 34A–34C are top views illustrating pawl engaging positions for a steering means in accordance with the present invention.
Figure 34B:
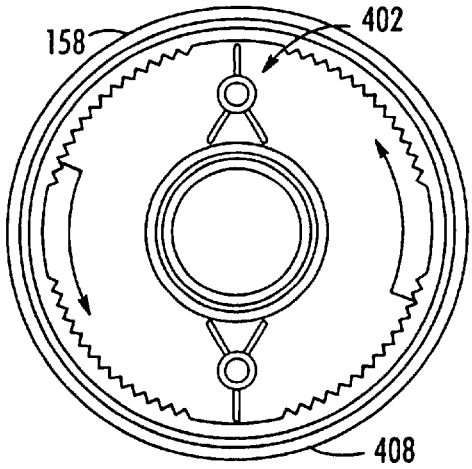
Figure 34C:
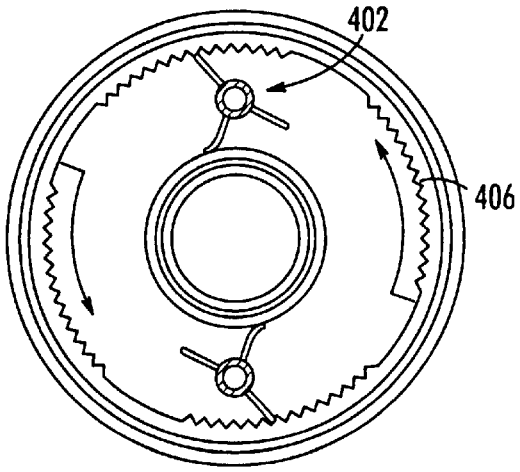
Figure 34D:
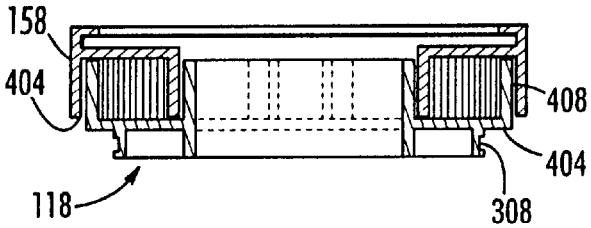
FIG. 34D is a side elevation view in cross section taken through the center thereof.
Figure 35:
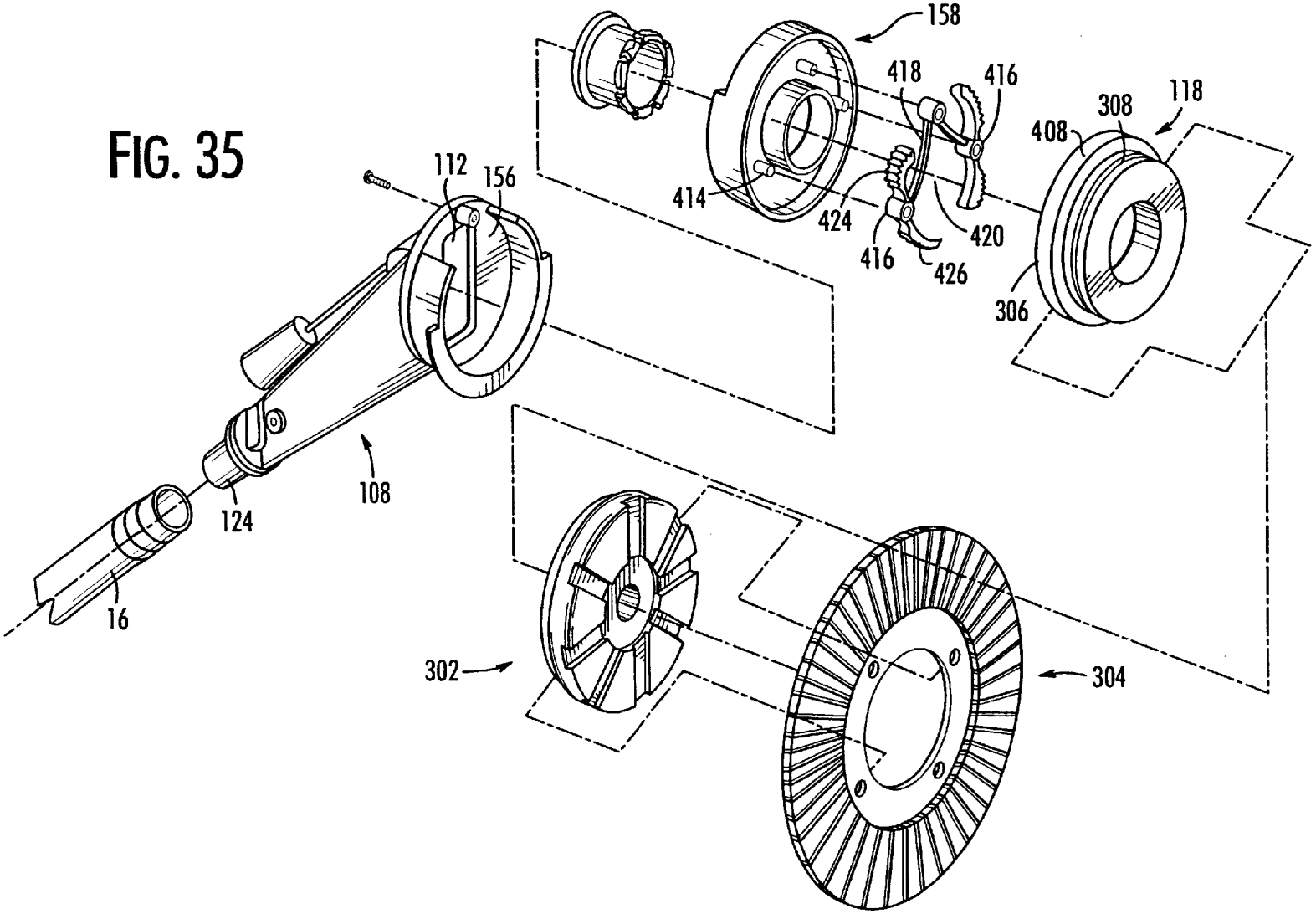
FIG. 35 is an exploded perspective view of an alternate embodiment of the present invention.

In operation, the pulsating fluid flow 122 through the chamber 110 causes the operating head 154, housing 100 and flexible hose 16 to jerk or vibrate and, as previously described, resultant forces move the cleaner 10 in a forward direction. Additionally, this action will cause slight movement of the foot 118 relative to the lower portion 144 of the operating head 154. If, as depicted in FIG. 34B, the pawl 402 is not engaged with a raised portion 406 of the cylindrical wall 408, the cleaner 10 will move forward until such movement causes the position of the attached flexible hose to alter and thereby apply a force against the hose coupling 16 to rotate the head 154. The incorporated lower portion 158 and attached pawls 402 moves toward the raised portion 406 of the cylindrical wall 408 of the foot. Continued application of the latter force rotates or deflects the pawl 402 and an attached flexible tab 410 until the pawl 402 engages the raised wall portion 406, as is illustrated with reference to FIGS. 34A and 34B. Once so engaged with the raised wall portion 406, the pawl 402 provides greater resistance to rotational movement in one direction than in the opposite direction. Consequently, the vibration of the cleaner 10 and a ratcheting action of at least one pawl 402 will cause rotation of the lower portion 158 of the operating head 154 relative to the cylindrical wall 408 of the foot 118. This ratcheting action and rotation about axis 412 will continue until the end of the raised portion 406 of the cylindrical wall 408. Those elements of the cleaner 10 fixed to the operating head 154 will also rotate relative to the foot 118 and the surface 12 to be cleaned. Since the cleaner 10 will move in the direction in which the hose coupling 16 points or is directed, if unobstructed, the cleaner will typically follow a curved course across the surface 12 to be cleaned. If the cleaner is lodged against a wall, a step or other obstacle in a swimming pool, when the pawl 402 is engaged, the cleaner will rotate in an opposition direction and thus away from the obstacle and then proceed in a new curved forward direction until the pawl 402 disengages. This process will be repeated as the hose 15 interacts with the cleaner to re-engage the pawl 402 and thereby recommence the ratcheting rotational action. In this manner, the tendency of a swimming pool cleaner 10 to establish a repetitive action or to become trapped by an obstacle, will be reduced or eliminated.

If continuous rotation in one direction is desired, the raised portion 406 of the cylindrical wall 408 may be continued around the wall 408, without any break. The pawls 402 can then be installed to provide rotation in a chosen clockwise or anti-clockwise direction.

It is expected that, without departing from the principles disclosed, modifications may be made to the embodiment of the above-described steering means. For example a pawl 402 may be attached to a foot (instead of an operating head) and engage a wall or other suitable surface of the operating head (instead of the wall 408 or other inside portion of a foot) of the cleaner 10. By way of further example, for frictional engagement with a pawl, a resilient insert is substituted for teeth of inner surface 412. These examples are not intended to exhaust the possible alternate embodiments of this invention.

Figure 36:
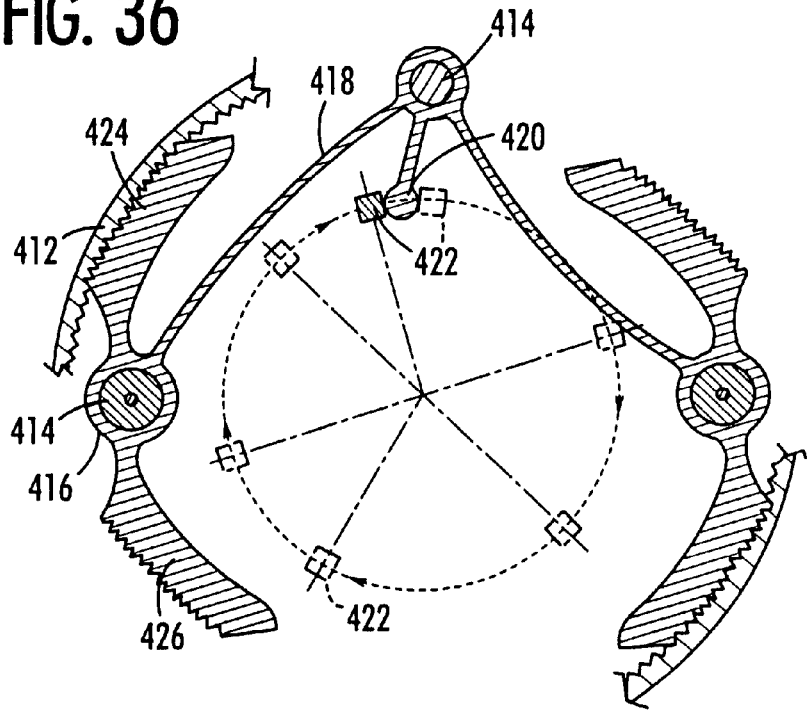
FIGS. 36 and 37 are partial top views of a ratchet and pawl embodiment in accordance with the present invention illustrating alternating biasing positions of the pawl.
Figure 37:
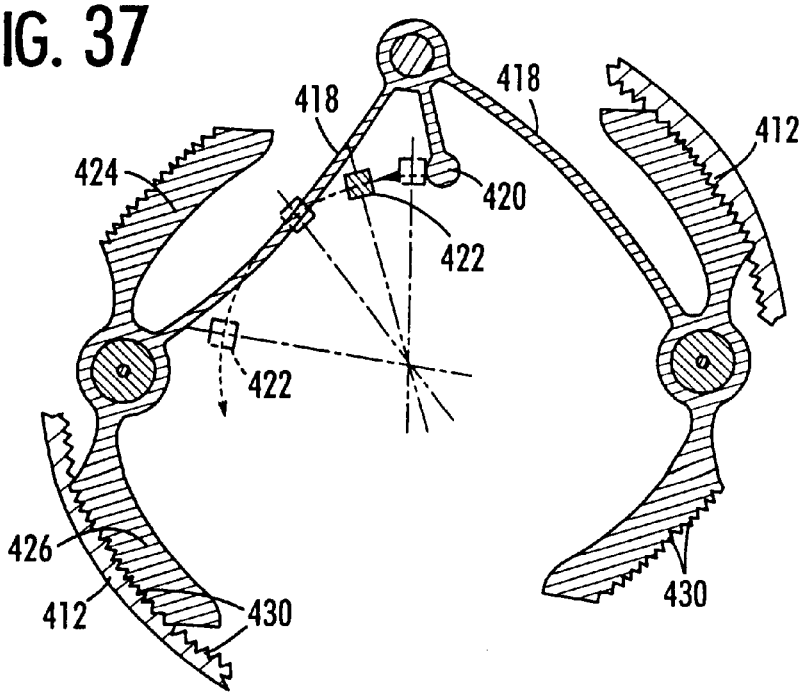

An alternate embodiment of steering means which will provide a cleaner 10 of the water interruption type having an inclined chamber 100 with steering in opposing directions without an intermittent period between directions is depicted in FIGS. 35–45. As with the previous embodiment, the steering means may conveniently be installed within the annular chamber 404 formed by the mating of a lower portion 158 of the operating head 154 and the cylindrical portion 408 of the foot 118. Each end of at least one resilient means such as a flexure 418 is connected to a sleeve 416, the resilient means and sleeves dimensioned to be rotatably attached to at least two shafts 414 fixed to the lower portion 158 of the operating head 154. The distance between the axes of rotation extending through the center of two shafts 414 shall, prior to attachment of the steering means to said shafts 414, be less than the distance between the center of the holes through two sleeves 416 interconnected by, for example, the flexure 418. Thus when each sleeve 416 is slid over a shaft 414, the flexure 418 must deform and thereby bias each sleeve 416 to a predetermined position relative to the shafts 414. An engagement means such as a finger 420 communicates with at least one sleeve 416 and, upon rotation of the foot 118, occasionally engages with means such as tab 422 attached with respect to the foot 118 or driven by the rotation of the foot 118. With reference to FIGS. 36 and 37, when the finger 420 and flexures 418 are positioned in a first position as shown in FIG.36, the application towards the right of increasing force against the left hand side of the finger 420, will, upon application of sufficient force, overcome the force stored in the deformed flexures 418, whereupon the flexures will rapidly deform and take up a second position as depicted in FIG. 37. Upon such deformation of the flexure 418 into the second position, the sleeves 416 will rotate through an arc to a second predetermined sleeve position. Attached to at least one sleeve 416 are two pawls 424 and 426 dimensioned so that when the sleeves 416 and flexure 418 are in a first position, a first pawl will engage an inner toothed surface 412 of the cylindrical wall 408 of the foot 118, and when the sleeves 416 and flexure 418 are in a second position, the second pawl will engage such surface 412. To facilitate frictional engagement, the face of a pawl and/or the inner surface 412 of the cylindrical wall 408 incorporate teeth 430 or comprise at least one resilient layer attached to the cylindrical wall 408.

In operation, the pulsating fluid flow 122 through the chamber 110 causes the operating head 154, chamber 110 and flexible hose 16 to jerk or vibrate and, as previously described, resultant forces move the cleaner 10 in a forward direction. Additionally, this action will cause slight movement of the foot 118 relative to the lower portion of the operating head 158. In this embodiment, at least one pawl 424 will be engaged with the surface 412 and will provide greater resistance to rotational movement of the lower portion of the operating head 158 relative to the foot 118 in one direction than in the opposite direction. By means of a ratcheting action, the pawl 424 will cause the lower portion 158 of the operating head 154 to rotate relative to the foot 118. This ratcheting action and rotation will continue in a first direction until a tab 422 driven by the rotation of the foot 118 engages a finger 420 and applies sufficient force thereto to cause the flexure 418 to deform to a second position and cause the first pawl 424 to disengage the surface 412 and a second pawl 426 to engage the inner surface 412. The ratcheting action and second pawl 426 will cause rotation in a second direction, opposite to the first direction. As earlier described, the tendency of a swimming pool cleaner 10 to establish a repetitive action or to become trapped by an obstacle, is greatly reduced or eliminated.

Figure 38:
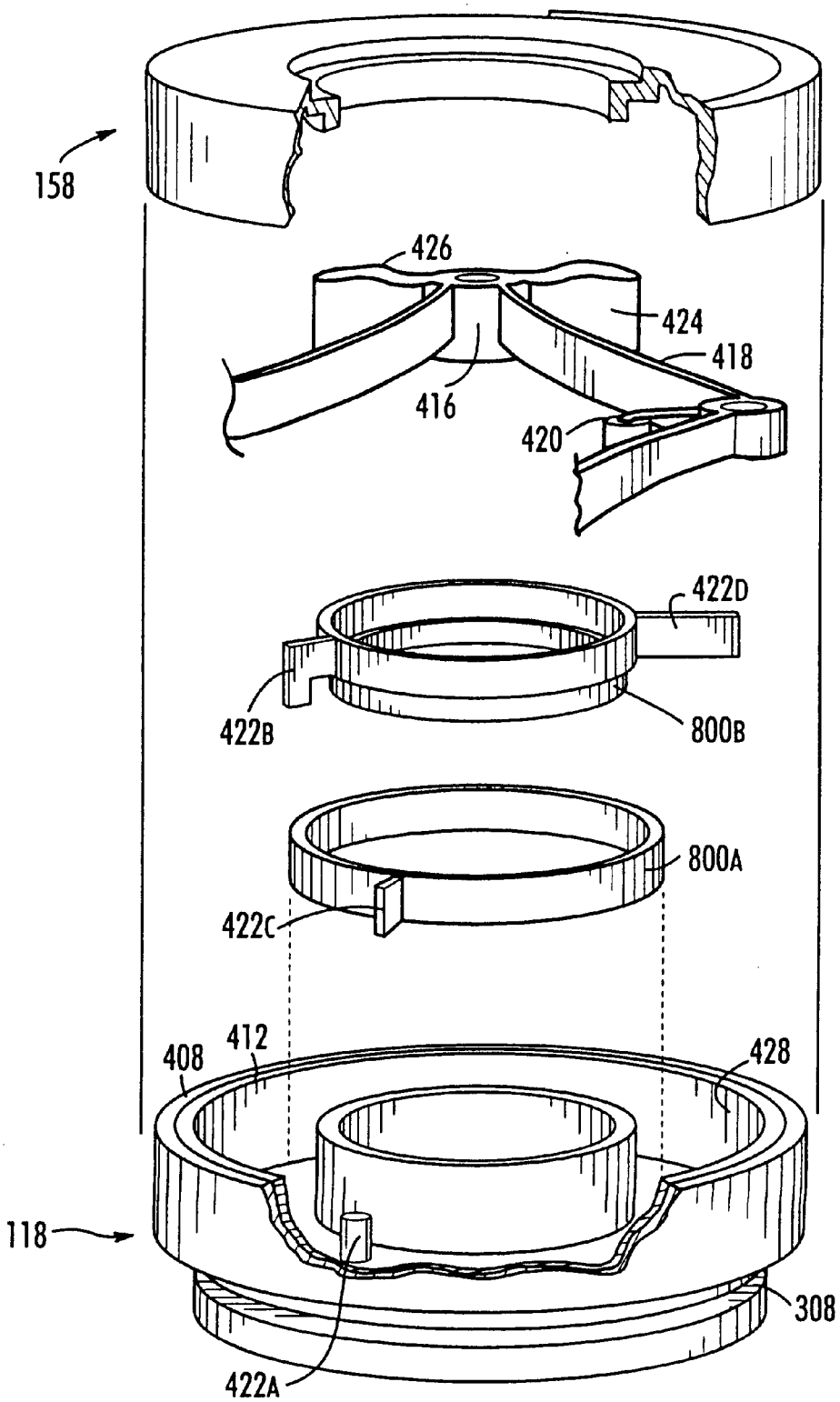
FIG. 38 is an exploded cut-away view of a steering device in accordance with the present invention.
Figure 39:
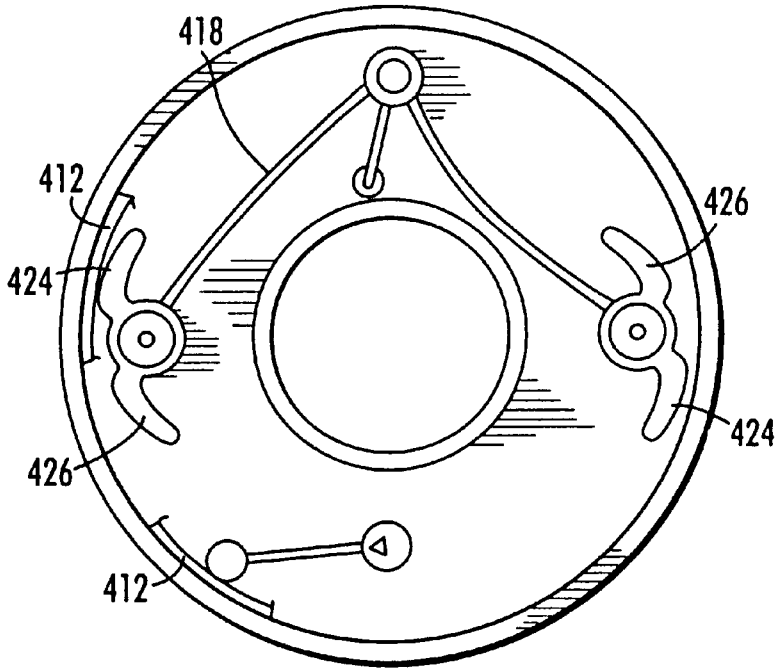
FIGS. 39 and 40 are top plan views of alternate ratchet and pawl embodiments in accordance with a steering means of the present invention.

In a preferred embodiment as illustrated in FIG. 38, the inside surface 412 of the cylindrical wall 408 is formed using a resilient, rubber-like layer 428 suitable for frictional engagement with pawls 424 and 426. The pawls 424 and 426 are camming pawls. When a free end of a camming pawl, say 424, is in frictional engagement with the resilient friction surface 412, vibration of the cleaner and a ratcheting action of the pawl 424 will result in rotation of the operating head 154 relative to the foot 118 in a first direction. Use of the resilient layer 428 on the surface 412 of the wall 408 or on the free end of a pawl 424 or 426 has an advantage over the use of teeth on either of those surfaces. The advantage is that the action of the pawl 424 or 426 is not limited by the size of any teeth and the need for the free end of a pawl 424 or 426 to consistently traverse any such teeth in order to provide an efficient ratcheting action. While the increments may become small if the hose, for example, applies significant torque in a direction opposite to that in which the steering means is rotating, a resilient friction layer 428 has been found to be effective in enabling the rotation to continue until the steering means switches rotation to a second direction.

The number of rotations that the lower portion 158 of the operating head 154 makes relative to the foot 118 is determined by the placement of tab or tabs 422 driven by the rotation of the foot. FIG. 38 illustrates a means employing at least one ring 800A, 800B, and additional tabs 422B, C, D, whereby tab 422D will engage finger 420 after more than one rotation in either direction. More than one rotation in each direction is particularly useful for consistent disengagement of a cleaner 10 from obstacles in a swimming pool.

Figure 40:
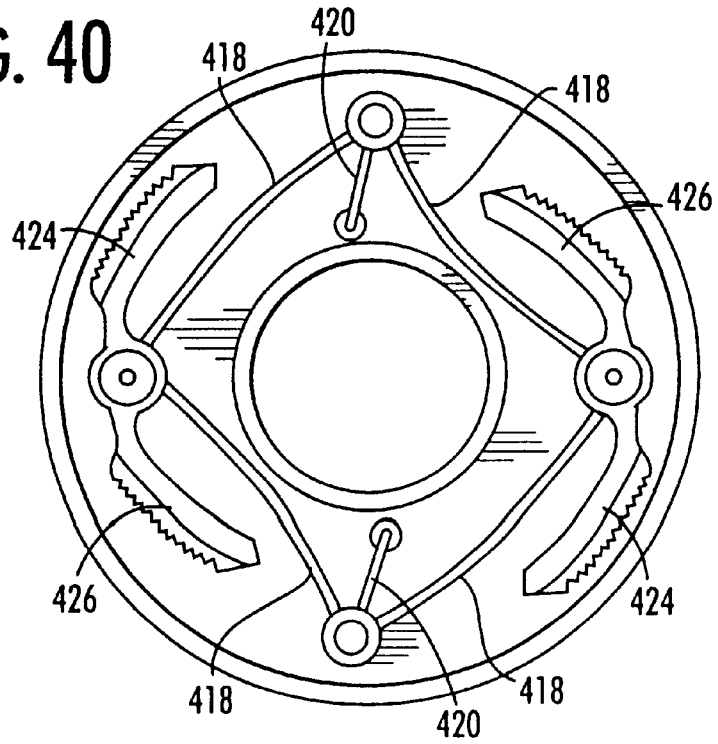
Figure 41:
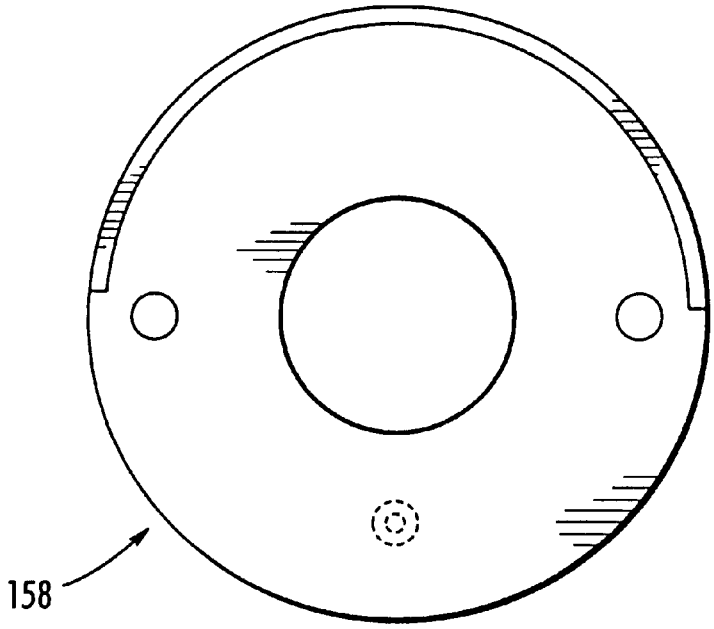
FIG. 41 is a top plan view of a cooperating upper portion of the steering means operable with FIGS. 39 and 40.

FIG. 40 illustrates that multiple linked flexures 418 and more than one engagement finger may be employed in this embodiment of steering means.

Figure 42:
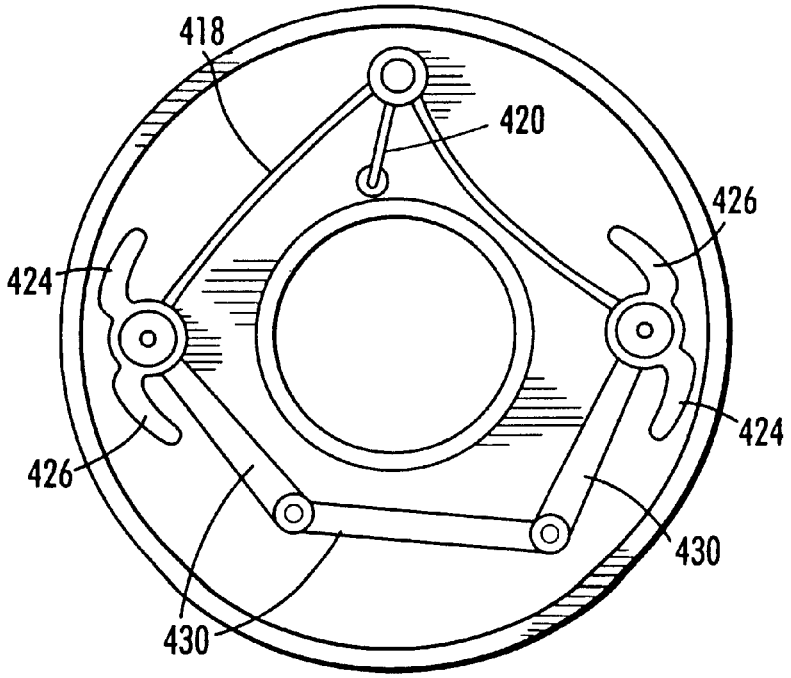
FIG. 42 is a top plan view of another ratchet and pawl embodiment in accordance with a steering means of the present invention.
Figure 43:
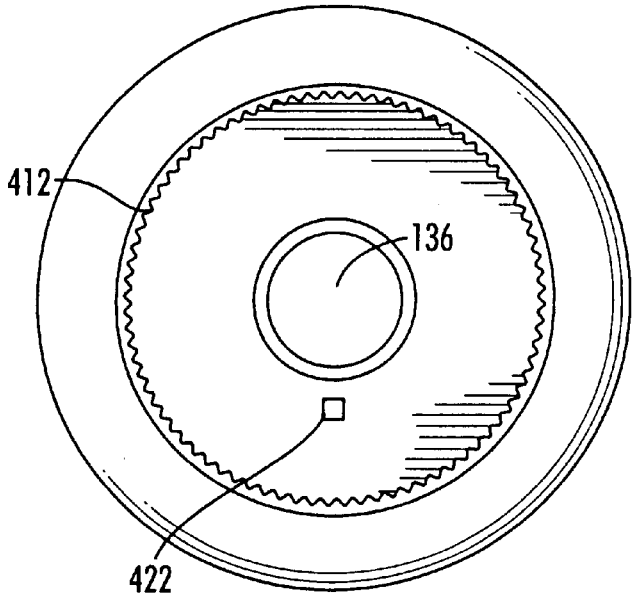
FIG. 43 is a top plan view of a cooperating upper portion of the steering means operable with FIG. 42.

In yet another embodiment, as illustrated with reference to FIG. 42, linkage arms 430 are used to link more than one pair of pawls 424 and 426. This arrangement is useful to assure that both flexures 418 and both pairs of pawls reliably orient themselves in a first and then a second position as required for operation of the invention. As will be obvious to those reasonably skilled in the art, a similar arrangement employing only a single flexure in combination with a linkage arrangement 430 will also satisfy the requirements and will fall within the scope of the invention.

Figure 44:
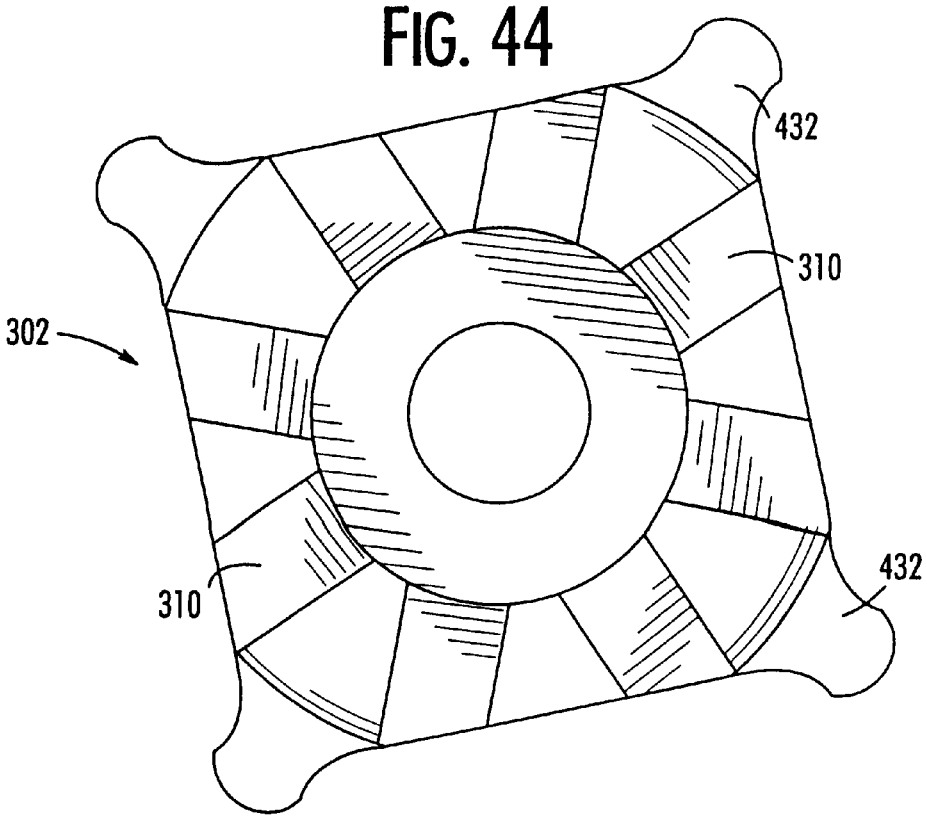
FIG. 44 is a bottom view of an alternate embodiment of a shoe.
Figure 45:
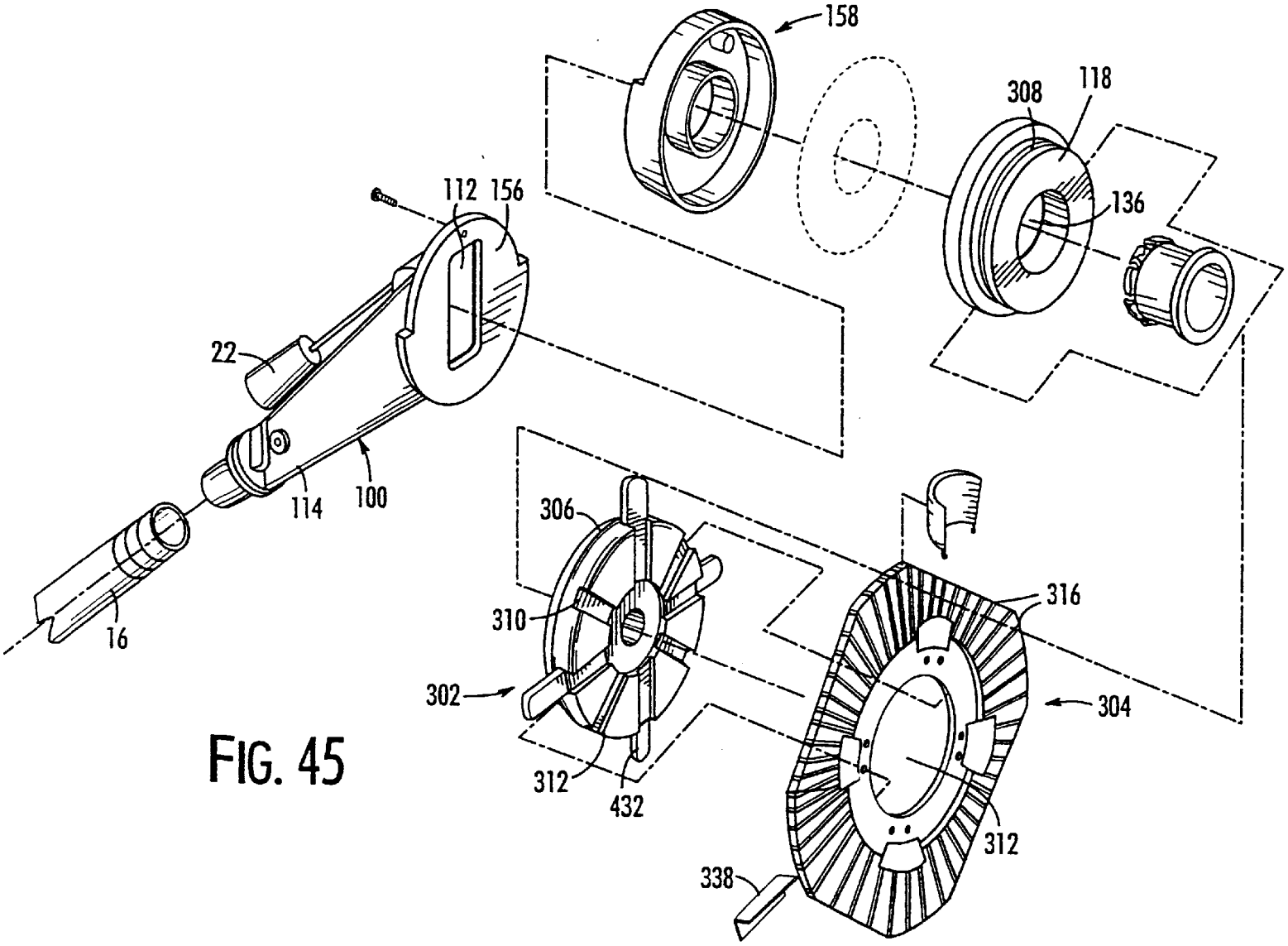
FIG. 45 is an exploded perspective view of an alternate embodiment of the present invention illustrating the use of the show in FIG. 44.

FIGS. 44 and 45 illustrate out-of-round shoes 302 and sealing flanges 304 either of which, upon engagement with a wall or obstacle, will reduce rotation of the shoe 302, sealing flange 304 and other surface engaging means relative to the surface 12 to be cleaned. This feature improves the rotation of the housing 100 and hose connector 16 relative to the surface to be cleaned. Once the housing 100 and hose connector have been driven through an arc by the steering means, the hose connector will point in a direction free of the obstruction, and the cleaner will move away from the obstacle. Resilient members 432 may be attached or integrally formed with the shoe 302. Such resilient members 432 enhance the grip of the shoe against a wall or obstacle. Other improvements which may be made to a shoe 302 are to increase its height and deepen the grooves 310 for increased fluid flow through a passageway formed between the shoe 302 and the surface 12 to be cleaned. Also, to reduce slippage of surface engaging means of the flange 12 against the surface 12 to be cleaned, sealing flange stiffeners 338 are attached to or integrally formed with the sealing flange 304.

A reading by those skilled in the art will bring to mind various changes without departing from the spirit and scope of the invention.

Figure 28:
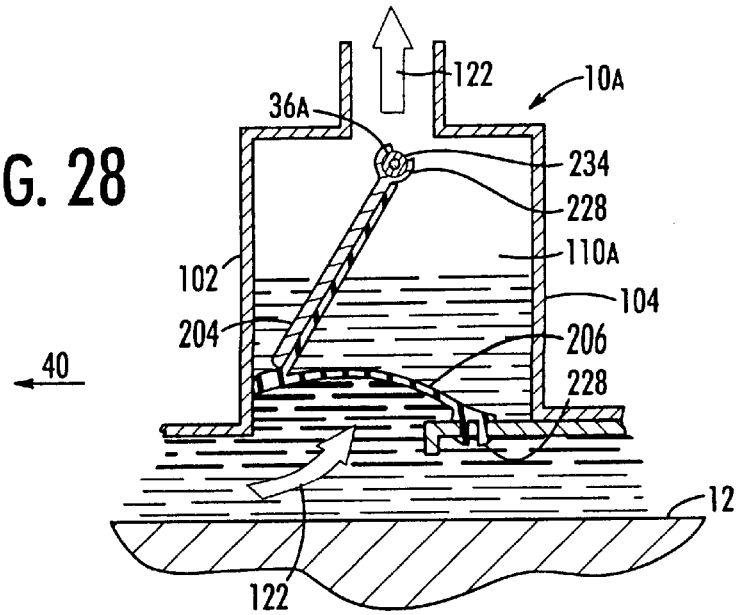
FIG. 28 is a partial cross section view of a flow control valve in accordance with the present invention illustrating operation within an alternate flow passage.

To this point, the embodiments of cleaners 10 incorporating the flow control valve 200 have all described at least the chamber 110 and consequently a significant dimension of the cleaner 10 to be forwardly inclined with respect to the surface 12 to be cleaned. FIGS. 1 through 6 illustrate such embodiments. The flow control valve 200 is, as a source of vibration or oscillatory motion, also suited for incorporation in cleaners in which the suction chamber 110 is substantially normal to the surface 12 to be cleaned. As illustrated with reference to FIG. 28, useful in the swimming pool cleaner described in U.S. Pat. No. 5,404,607 to Sebor. FIG. 28 illustrates a flow control valve of this invention incorporated into the suction chamber 110 of a cleaner 10A where the suction chamber 110A is not inclined. A preferred embodiment of a cleaner described in the '607 patent further requires that a shaft disposed in the chamber be driven and engage a means to translate the reciprocating angular movement of the shaft into one directional angular movement of a driven gear. The flow control valve 200 of the present invention will provide a reciprocating angular movement to a sleeve 102 or drive shaft 234, which movement may be translated and coupled with other mechanisms necessary to perform a number functions for a pool cleaning device, including steering functions.

Many modifications and other embodiments of the invention will come to the mind of one skilled in the art having the benefit of the teachings presented in the foregoing descriptions and the associated drawings. The specific embodiment shown in the accompanying drawings and described herein is offered by way of illustration only. Therefore, it is to be understood that the invention is not to be limited to the specific embodiments disclosed, and that modifications and alternate embodiments are intended to be included within the scope of the appended claims.

That which is claimed:

1. A swimming pool cleaning device for automatically cleaning a surface submerged in liquid, the cleaning device comprising:

a forwardly inclined housing having rigid walls forming a flow passage extending therethrough from an inlet which in use is proximate a surface to be cleaned, to an outlet for connection to a flexible suction hose;

a flow control valve operable within the flow passage, the flow control valve comprising:

a rigid flap member having a pivot end pivotably connected to the housing and an opposing seat end movable from a seated position biased against a first wall portion of the housing, to an unseated position in a spaced relation to the first wall portion; and a flexible flap member having first and second ends, and opposing sides therebetween, the first end of the flexible portion attached to a second wall portion of the housing opposing the first wall portion, the second end of the flexible portion attached to the seat end of the rigid flap member, the flexible flap member extending across the flow passage for blocking flow therethrough when the rigid flap member is in the seated position, and retractable from the second wall portion for permitting fluid flow through the flow passage when the rigid flap member is in the unseated position;

a shoe carried by the housing at the inlet for engaging a surface of a pool to be cleaned; and a flexible flange extending around the shoe, when in use, the shoe and flange frictionally engaging the surface to be cleaned.

2. The cleaning device according to claim 1, wherein the first wall includes a recess for receiving the seat end of the rigid flap member, and wherein the valve further comprises an impact absorbing buffer carried on the seat end for cushioning an impact of the seat end with the first wall.

3. The cleaning device according to claim 1, wherein the first wall of the housing comprises a forward wall.

4. The cleaning device according to claim 1, wherein the flexible flap member comprises:

an upstream portion having first and second ends, the first end of the upstream portion attached to the second wall portion of the housing and the second end of the upstream portion attached to the seat end of the rigid portion; and a downstream portion having first and second ends, the first end of the downstream portion attached to the second wall portion of the housing at a position displaced downstream from the first end of the upstream portion, and the second end of the downstream portion attached to the second end of the rigid flap member, the upstream and downstream portions forming a fluid buffer chamber with the side wall portion.

5. The cleaning device according to claim 4, wherein the side wall portion includes an aperture therethrough, and wherein the aperture is positioned for providing fluid flow into the fluid buffer chamber.

6. The cleaning device according to claim 1, wherein the valve further comprises a stop operable with the rigid flap member for limiting the spaced relation of the rigid flap member to the first wall and thus govern an arc through which the rigid flap moves and a rate of reciprocating movement thereof.

7. The cleaning device according to claim 1, wherein the flexible flap member comprises at least two hingedly attached rigid elements.

8. The cleaning device according to claim 1, further comprising a seal extending along an edge of the rigid flap member for biasing against a side wall of the housing in a sealing relationship between the rigid flap member and the side wall of the housing.

9. The cleaning device according to claim 1, wherein the housing further comprises attaching means for removably attaching the first wall thereto, the first wall readily removable from the housing for access to the flow passage.

10. The cleaning device according to claim 1, wherein the shoe comprises a resilient body having a bottom surface for engaging the surface to be cleaned and a central opening for passage of debris and fluid flow therethrough to the inlet of the housing, the resilient body having a groove within the bottom surface extending from the opening radially outward to the periphery, the groove forming a channel with the surface to be cleaned for passage of debris and fluid flow through the channel.

11. The cleaning device according to claim 1, wherein the flexible flange comprises a generally disc shaped sealing flange having a central opening therethrough and a peripheral edge extending therefrom and around the opening, the flange further having an intake aperture and a flexible flap extending into the intake aperture, the flexible flap adjusting the size of the intake aperture in response to fluid flow therethrough.

12. The cleaning device according to claim 11, wherein the flexible flange further comprises slits extending from the peripheral edge inward toward the central opening to form a pedal-like segmented flange for splaying of each segment in response to travel of the cleaner over an irregularly contoured surface and thus facilitate an effective frictional contact therewith, the slits extending to less than half a distance from the peripheral edge to the opening.

13. The cleaning device according to claim 12, wherein the flexible flange further comprises a pleat affixed across the slit for allowing the splaying while limiting seepage of fluid through the slits.

14. The cleaning device according to claim 1, wherein the housing is rotatable about the shoe and flange.

15. The cleaning device according to claim 1, further comprising steering means operable for rotating the housing about the shoe and flange.

16. The cleaning device according to claim 15, wherein the steering means comprises:

an upper member carried by the housing;

a lower member carried by the shoe, the lower member rotatable with the upper member about an axis of rotation, when in use, the axis of rotation generally perpendicular to the surface to be cleaned; and ratchet and pawl means operable between the upper and lower members for providing free rotation in one direction about the axis in response to a pulsating fluid flow through the flow passage, while biasing against rotation in an opposing direction.

17. The cleaning device according to claim 16, wherein the ratchet and pawl means comprise:

a pivot pin carried by the upper member;

the lower member having a cylindrical surface extending around the axis of rotation for engagement by the pawl; and a pawl pivotally attached to the pin and engaging the cylindrical surface.

18. The cleaning device according to claim 17, wherein the cylindrical surface includes a smooth surface portion over which the pawl will slide and thus provide free rotation of the housing through an arc of the smooth surface.

19. The cleaning device according to claim 16, wherein the ratchet and pawl means comprise:

a tab carried by the upper member;

a pawl having first and second pawl portions pivotable about a center pawl portion for engaging the lower member with the first pawl portion for providing free rotation of the housing about the axis in the one direction while biasing against rotation in the opposing direction, and for pivoting about the center pawl portion for engaging the lower member with the second pawl portion for providing free rotation of the housing about the axis in the opposing while biasing against rotation in the one direction;

a lever arm extending from the center pawl portion, the lever arm biasing against the tab from a first side when rotated about the one direction for causing the first pawl portion to engage the lower member, and the lever arm biasing against the tab from an opposing second side of the tab when rotated about the opposing direction for causing the second pawl portion to engage the lower member, thus providing a steering of the cleaning device.

20. The cleaning device according to claim 1, further comprising a hose coupling rotatable carried by the housing at the outlet for connection of a flexible hose.

21. The pool cleaning device according to claim 1, further comprising a bumper assembly rotatable about the housing, the bumper assembly comprising:

a ring spaced from and extending around the housing;

a coupling rotatably attached to the hose coupling; and elongated spokes extending radially outward from the coupling to the ring for holding the ring in a spaced relation to and around the housing.

22. The pool cleaning device according to claim 1, further comprising a buoyancy means operable with the housing for upwardly buoying a trailing edge portion of the housing.

23. The pool cleaner according to claim 22, wherein the buoyancy means comprises:

a float; and a flexible rod having a proximal end hingedly attached to the housing trailing edge portion and a distal end attached to the float.

24. The pool cleaner according to claim 23, further comprising the housing trailing edge portion having an arcuate slot transversely extending across the housing and wherein the proximal end of the flexible rod is slidable within the arcuate slot.

25. The pool cleaner according to claim 22, further comprising a weight extending outwardly and forwardly from the housing for urging a leading edge of the housing downward, the weight positioned for cooperating with the buoyancy means in turning the cleaner downward when the cleaner is traveling along a swimming pool side generally vertical side wall.

26. A swimming pool cleaning device for automatically cleaning a surface submerged in liquid, the cleaning device comprising:

a forwardly inclined housing having rigid walls forming a flow passage extending therethrough from an inlet which in use is proximate a surface to be cleaned, to an outlet for connection to a flexible suction hose;

a flow control valve operable within the flow passage;

a shoe carried by the housing at the inlet for engaging a surface of a pool to be cleaned, the shoe having a resilient body having a bottom surface for engaging the surface to be cleaned and a central opening for passage of debris and fluid flow therethrough to the inlet of the housing, the resilient body having a groove within the bottom surface extending from the opening radially outward to the periphery, the groove forming a channel with the surface to be cleaned for passage of debris and fluid flow through the channel; and a flexible flange extending around the shoe, when in use, the shoe and flange engaging the surface to be cleaned, the flexible flange having a central opening therethrough communicating with the central opening of the shoe and a peripheral edge extending therefrom and around the central opening, the flexible flange further having an intake aperture for providing fluid flow therethrough to the channel, and a flexible flap extending into the intake aperture, the flexible flap adjusting the size of the intake aperture in response to fluid flow therethrough.

27. The cleaning device according to claim 26, wherein the flow control valve comprises:

a rigid flap member having a pivot end pivotably connected to the housing and an opposing seat end movable from a seated position biased against a first wall portion of the housing, to an unseated position in a spaced relation to the first wall portion; and a flexible flap member having first and second ends, and opposing sides therebetween, the first end of the flexible portion attached to a second wall portion of the housing opposing the first wall portion, the second end of the flexible portion attached to the seat end of the rigid flap member, the flexible flap member extending across the flow passage for blocking flow therethrough when the rigid flap member is in the seated position, and retractable from the second wall portion for permitting fluid flow through the flow passage when the rigid flap member is in the unseated position.

28. The cleaning device according to claim 27, wherein the first wall includes a recess for receiving the seat end of the rigid flap member, and wherein the valve further comprises an impact absorbing buffer carried on the seat end for cushioning an impact of the seat end with the first wall.

29. The cleaning device according to claim 27, wherein the first wall of the housing comprises a forward wall.

30. The cleaning device according to claim 27, wherein the flexible flap member comprises:

an upstream portion having first and second ends, the first end of the upstream portion attached to the second wall portion of the housing and the second end of the upstream portion attached to the seat end of the rigid portion; and a downstream portion having first and second ends, the first end of the downstream portion attached to the second wall portion of the housing at a position displaced downstream from the first end of the upstream portion, and the second end of the downstream portion attached to the second end of the rigid flap member, the upstream and downstream portions forming a fluid buffer chamber with the side wall portion.

31. The cleaning device according to claim 30, wherein the side wall portion include an aperture therethrough, wherein the aperture is positioned for providing fluid flow into the fluid buffer chamber.

32. The cleaning device according to claim 27, wherein the valve further comprises a stop operable with the rigid flap member for limiting the spaced relation of the rigid flap member to the first wall and thus govern an arc through which the rigid flap moves and a rate of reciprocating movement thereof.

33. The cleaning device according to claim 27, wherein the flexible flap member comprises at least two hingedly attached rigid elements.

34. The cleaning device according to claim 27, further comprising a seal extending along an edge of the rigid flap member for biasing against a side wall of the housing in a sealing relationship between the rigid flap member and the side wall of the housing.

35. The cleaning device according to claim 27, wherein the housing further comprises attaching means for removably attaching the first wall thereto, the first wall readily removable from the housing for access to the flow passage.

36. The cleaning device according to claim 26, wherein the flexible flange further comprises slits extending from the peripheral edge inward toward the central opening to form a pedal-like segmented flange for splaying of each segment in response to travel of the cleaner over an irregularly contoured surface and thus facilitate an effective frictional contact therewith, the slits extending to less than half a distance from the peripheral edge to the opening.

37. The cleaning device according to claim 36, wherein the flexible flange further comprises a pleat affixed across the slit for allowing the splaying while limiting seepage of fluid through the slits.

38. The cleaning device according to claim 26, wherein the housing is rotatable about the shoe and flange.

39. The cleaning device according to claim 26, further comprising steering means operable for rotating the housing about the shoe and flange.

40. The cleaning device according to claim 39, wherein the steering means comprises:

an upper member carried by the housing;

a lower member carried by the shoe, the lower member rotatable with the upper member about an axis of rotation, when in use, the axis of rotation generally perpendicular to the surface to be cleaned; and ratchet and pawl means operable between the upper and lower members for providing free rotation in one direction about the axis in response to a pulsating fluid flow through the flow passage, while biasing against rotation in an opposing direction.

41. The cleaning device according to claim 40, wherein the ratchet and pawl means comprise:

a pivot pin carried by the upper member;

the lower member having a cylindrical surface extending around the axis of rotation for engagement by the pawl; and a pawl pivotally attached to the pin and engaging the cylindrical surface.

42. The cleaning device according to claim 41, wherein the cylindrical surface includes a smooth surface portion over which the pawl will slide and thus provide free rotation of the housing through an arc of the smooth surface.

43. The cleaning device according to claim 39, wherein the ratchet and pawl means comprise:

a tab carried by the upper member;

a pawl having first and second pawl portions pivotable about a center pawl portion for engaging the lower member with the first pawl portion for providing free rotation of the housing about the axis in the one direction while biasing against rotation in the opposing direction, and for pivoting about the center pawl portion for engaging the lower member with the second pawl portion for providing free rotation of the housing about the axis in the opposing while biasing against rotation in the one direction;

a lever arm extending from the center pawl portion, the lever arm biasing against the tab from a first side when rotated about the one direction for causing the first pawl portion to engage the lower member, and the lever arm biasing against the tab from an opposing second side of the tab when rotated about the opposing direction for causing the second pawl portion to engage the lower member, thus providing a steering of the cleaning device.

44. The cleaning device according to claim 26, further comprising a hose coupling rotatable carried by the housing at the outlet for connection of a flexible hose.

45. The pool cleaning device according to claim 26, further comprising a bumper assembly rotatable about the housing, the bumper assembly comprising:

a ring spaced from and extending around the housing;

a coupling rotatably attached to the hose coupling; and elongated spokes extending radially outward from the coupling to the ring for holding the ring in a spaced relation to and around the housing.

46. The pool cleaning device according to claim 26, further comprising a buoyancy means operable with the housing for upwardly buoying a trailing edge portion of the housing.

47. The pool cleaner according to claim 46, wherein the buoyancy means comprises:

a float; and a flexible rod having a proximal end hingedly attached to the housing trailing edge portion and a distal end attached to the float.

48. The pool cleaner according to claim 46, further comprising the housing trailing edge portion having an arcuate slot transversely extending across the housing and wherein the proximal end of the flexible rod is slidable within the arcuate slot.

49. The pool cleaner according to claim 46, further comprising a weight extending outwardly and forwardly from the housing for urging a leading edge of the housing downward, the weight positioned for cooperating with the buoyancy means in turning the cleaner downward when the cleaner is traveling along a swimming pool side generally vertical side wall.

50. A swimming pool cleaning device for automatically cleaning a surface submerged in liquid, the cleaning device comprising:

a housing having rigid walls forming a flow passage extending therethrough from an inlet which in use is proximate a surface to be cleaned, to an outlet for connection to a flexible suction hose;

a flow control valve operable within the flow passage;

a shoe carried by the housing at the inlet for engaging a surface of a pool to be cleaned;

a flexible flange extending around the shoe, when in use, the shoe and flange engaging the surface to be cleaned; and steering means carried by the housing and operable therewith for rotating the housing about the shoe and flange, said steering means comprising an upper member carried by the housing and a lower member carried by the shoe, the lower member rotatable with the upper member about an axis of rotation, when in use, the axis of rotation generally perpendicular to the surface to be cleaned.

51. The cleaning device according to claim 50, wherein the steering means further comprising:

ratchet and pawl means operable between the upper and lower members for providing free rotation in one direction about the axis in response to a pulsating fluid flow through the flow passage, while biasing against rotation in an opposing direction.

52. The cleaning device according to claim 51, wherein the ratchet and pawl means comprise:

a pivot pin carried by the upper member;

the lower member having a cylindrical surface extending around the axis of rotation for engagement by the pawl; and a pawl pivotally attached to the pin and engaging the cylindrical surface.

53. The cleaning device according to claim 52, wherein the cylindrical surface includes a smooth surface portion over which the pawl will slide and thus provide free rotation of the housing through an arc of the smooth surface.

54. The cleaning device according to claim 51, wherein the ratchet and pawl means comprise:

a tab carried by the upper member;

a pawl having first and second pawl portions pivotable about a center pawl portion for engaging the lower member with the first pawl portion for providing free rotation of the housing about the axis in the one direction while biasing against rotation in the opposing direction, and for pivoting about the center pawl portion for engaging the lower member with the second pawl portion for providing free rotation of the housing about the axis in the opposing while biasing against rotation in the one direction;

a lever arm extending from the center pawl portion, the lever arm biasing against the tab from a first side when rotated about the one direction for causing the first pawl portion to engage the lower member, and the lever arm biasing against the tab from an opposing second side of the tab when rotated about the opposing direction for causing the second pawl portion to engage the lower member, thus providing a steering of the cleaning device.

55. The cleaning device according to claim 50, wherein the flow control valve comprises:

a rigid flap member having a pivot end pivotably connected to the housing and an opposing seat end movable from a seated position biased against a first wall portion of the housing, to an unseated position in a spaced relation to the first wall portion; and a flexible flap member having first and second ends, and opposing sides therebetween, the first end of the flexible portion attached to a second wall portion of the housing opposing the first wall portion, the second end of the flexible portion attached to the seat end of the rigid flap member, the flexible flap member extending across the flow passage for blocking flow therethrough when the rigid flap member is in the seated position, and retractable from the second wall portion for permitting fluid flow through the flow passage when the rigid flap member is in the unseated position.

56. The cleaning device according to claim 55, wherein the first wall includes a recess for receiving the seat end of the rigid flap member, and wherein the valve further comprises an impact absorbing buffer carried on the seat end for cushioning an impact of the seat end with the first wall.

57. The cleaning device according to claim 55, wherein the first wall of the housing comprises a forward wall.

58. The cleaning device according to claim 55, wherein the flexible flap member comprises:

an upstream portion having first and second ends, the first end of the upstream portion attached to the second wall portion of the housing and the second end of the upstream portion attached to the seat end of the rigid portion; and a downstream portion having first and second ends, the first end of the downstream portion attached to the second wall portion of the housing at a position displaced downstream from the first end of the upstream portion, and the second end of the downstream portion attached to the second end of the rigid flap member, the upstream and downstream portions forming a fluid buffer chamber with the side wall portion.

59. The cleaning device according to claim 58, wherein the side wall portion include an aperture therethrough, wherein the aperture is positioned for providing fluid flow into the fluid buffer chamber.

60. The cleaning device according to claim 55, wherein the valve further comprises a stop operable with the rigid flap member for limiting the spaced relation of the rigid flap member to the first wall and thus govern an arc through which the rigid flap moves and a rate of reciprocating movement thereof.

61. The cleaning device according to claim 55, wherein the flexible flap member comprises at least two hingedly attached rigid elements.

62. The cleaning device according to claim 55, further comprising a seal extending along an edge of the rigid flap member for biasing against a side wall of the housing in a sealing relationship between the rigid flap member and the side wall of the housing.

63. The cleaning device according to claim 55, wherein the housing further comprises attaching means for removably attaching the first wall thereto, the first wall readily removable from the housing for access to the flow passage.

64. The cleaning device according to claim 50, wherein the shoe comprises a resilient body having a bottom surface for engaging the surface to be cleaned and a central opening for passage of debris and fluid flow therethrough to the inlet of the housing, the resilient body having a groove within the bottom surface extending from the opening radially outward to the periphery, the groove forming a channel with the surface at to be cleaned for passage of debris and fluid flow through the channel.

65. The cleaning device according to claim 50, wherein the flexible flange comprises a generally disc shaped sealing flange having a central opening therethrough and a peripheral edge extending therefrom and around the opening, the flange further having an intake aperture and a flexible flap extending into the intake aperture, the flexible flap adjusting the size of the intake aperture in response to fluid flow therethrough.

66. The cleaning device according to claim 65, wherein the flexible flange further comprises slits extending from the peripheral edge inward toward the central opening to form a pedal-like segmented flange for splaying of each segment in response to travel of the cleaner over an irregularly contoured surface and thus facilitate an effective frictional contact therewith, the slits extending to less than half a distance from the peripheral edge to the opening.

67. The cleaning device according to claim 66, wherein the flexible flange further comprises a pleat affixed across the slit for allowing the splaying while limiting seepage of fluid through the slits.

68. The cleaning device according to claim 50, further comprising a hose coupling rotatable carried by the housing at the outlet for connection of a flexible hose.

69. The pool cleaning device according to claim 50, further comprising a bumper assembly rotatable about the housing, the bumper assembly comprising:

a ring spaced from and extending around the housing;

a coupling rotatably attached to the hose coupling; and elongated spokes extending radially outward from the coupling to the ring for holding the ring in a spaced relation to and around the housing.

70. The pool cleaning device according to claim 50, further comprising a buoyancy means operable with the housing for upwardly buoying a trailing edge portion of the housing.

71. The pool cleaner according to claim 70, wherein the buoyancy means comprises:

a float; and a flexible rod having a proximal end hingedly attached to the housing trailing edge portion and a distal end attached to the float.

72. The pool cleaner according to claim 71, further comprising the housing trailing edge portion having an arcuate slot transversely extending across the housing and wherein the proximal end of the flexible rod is slidable within the arcuate slot.

73. The pool cleaner according to claim 70, further comprising a weight extending outwardly and forwardly from the housing for urging a leading edge of the housing downward, the weight positioned for cooperating with the buoyancy means in turning the cleaner downward when the cleaner is traveling along a swimming pool side generally vertical side wall.

* * * * *